US009880479B2

(12) United States Patent
Santoh et al.

(10) Patent No.: US 9,880,479 B2
(45) Date of Patent: Jan. 30, 2018

(54) TONER, TONER STORED UNIT, IMAGE FORMING APPARATUS, AND IMAGE FORMING METHOD

(71) Applicants: Hideyuki Santoh, Shizuoka (JP); Tsuyoshi Sugimoto, Shizuoka (JP); Akinori Saitoh, Shizuoka (JP); Shin Hasegawa, Shizuoka (JP); Suzuka Amemori, Shizuoka (JP); Kohsuke Nagata, Shizuoka (JP); Koh Ohnuma, Shizuoka (JP)

(72) Inventors: Hideyuki Santoh, Shizuoka (JP); Tsuyoshi Sugimoto, Shizuoka (JP); Akinori Saitoh, Shizuoka (JP); Shin Hasegawa, Shizuoka (JP); Suzuka Amemori, Shizuoka (JP); Kohsuke Nagata, Shizuoka (JP); Koh Ohnuma, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/404,292

(22) Filed: Jan. 12, 2017

(65) Prior Publication Data

US 2017/0199476 A1 Jul. 13, 2017

(30) Foreign Application Priority Data

Jan. 12, 2016 (JP) ..... 2016-003640

(51) Int. Cl.

| | |
|---|---|
| ***G03G 9/08*** | (2006.01) |
| ***G03G 9/087*** | (2006.01) |
| ***G03G 15/08*** | (2006.01) |

(52) U.S. Cl.
CPC ..... *G03G 9/08702* (2013.01); *G03G 15/08* (2013.01)

(58) Field of Classification Search
CPC ..... G03G 9/0821
See application file for complete search history.

(56) References Cited

U.S. PATENT DOCUMENTS

| | | | |
|---|---|---|---|
| 7,052,815 | B2 | 5/2006 | Sawada et al. |
| 8,026,031 | B2 | 9/2011 | Watanabe et al. |
| 2008/0227013 | A1 | 9/2008 | Kadota et al. |
| 2008/0227018 | A1 | 9/2008 | Awamura et al. |

FOREIGN PATENT DOCUMENTS

| | | | |
|---|---|---|---|
| JP | 2001-158819 | A | 6/2001 |
| JP | 2002-287400 | A | 10/2002 |
| JP | 2002-351143 | A | 12/2002 |
| JP | 2007-271789 | A | 10/2007 |
| JP | 2014-178530 | A | 9/2014 |

*Primary Examiner* — Hoa V Le
(74) *Attorney, Agent, or Firm* — Oblon, McClelland, Maier & Neustadt, L.L.P.

(57) ABSTRACT

Toner that includes a polyester resin, fluorine and aluminum. The toner satisfies formulae (1) and (2), $$1.00 \geq AB/B \geq 0.50 \quad (1)$$

$$0 \leq (A-AB)/A \leq 0.25 \quad (2)$$

where A represents an area where the fluorine exists measured by Energy Dispersive X-ray Spectroscopy (EDS), B represents an area where the aluminum exists measured by Energy Dispersive X-ray Spectroscopy (EDS) and AB represents an overlapping area between A and B. Toner stored unit, image forming apparatus, and image forming method.

6 Claims, 5 Drawing Sheets

TONER, TONER STORED UNIT, IMAGE FORMING APPARATUS, AND IMAGE FORMING METHOD

CROSS-REFERENCE TO RELATED APPLICATIONS

This patent application is based on and claims priority pursuant to 35 U.S.C. §119 to Japanese Patent Application No. 2016-003640, filed on Jan. 12, 2016, in the Japan Patent Office, the entire disclosure of which is hereby incorporated by reference herein.

BACKGROUND

Technical Field

The present application relates to toner, toner stored unit, image forming apparatus, and image forming method.

Description of the Related Art

In recent years, toners have been required to have smaller particle diameters and hot offset resistance for increasing quality of output images, to have low temperature fixing ability for energy saving, and to have heat resistant storage stability for the toners to be resistant to high-temperature, high-humidity conditions during storage and transportation after production. In particular, improvement in low temperature fixing ability is very important because power consumption during fixing occupies much of the power consumption in an image forming step.

SUMMARY

The present application aims to solve the above problems pertinent in the art and achieve certain objects by providing a toner that addresses these problems, and others.

That is, a toner is provided comprising a polyester resin, fluorine and aluminum, wherein the toner satisfies formulae (1) and (2), $$1.00 \geq AB/B \geq 0.50 \quad (1)$$

$$0 \leq (A-AB)/A \leq 0.25 \quad (2)$$

where A represents an area in which the fluorine exists as measured by Energy Dispersive X-ray Spectroscopy (EDS), B represents an area in which the aluminum exists as measured by Energy Dispersive X-ray Spectroscopy (EDS), and AB represents an overlapping area between A and B.

DETAILED DESCRIPTION

Toner

Figure 1:
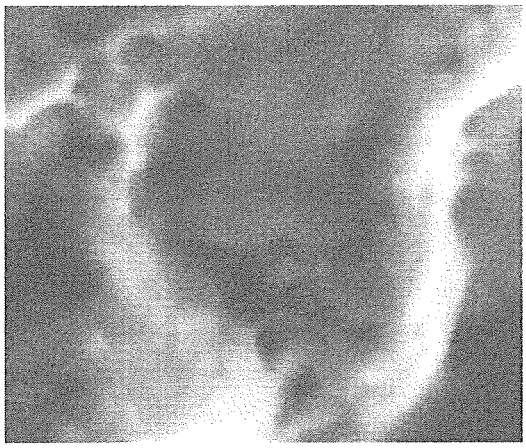
FIG. 1 is an image of scanning electron microscope of one example of a toner of the present application.

A toner of the present application includes a polyester resin, fluorine and aluminum. The toner satisfies formulae (1) and (2), $$1.00 \geq AB/B \geq 0.50 \quad (1),$$

$$0 \leq (A-AB)/A \leq 0.25 \quad (2)$$

where A represents an area in which the fluorine exists measured by Energy Dispersive X-ray Spectroscopy (EDS), B represents an area in which the aluminum exists measured by Energy Dispersive X-ray Spectroscopy (EDS) and AB represents an overlapping area between A and B.

Preferred values of AB/B include 0.55, 0.6. 0.65. 0.7, 0.75, 0.8, 0.85, 0.9, and 0.95. Preferred values of (A-AB)/A include 0.05, 0.1, 0.15 and 0.2.

The toner of the present application preferably includes a material including aluminum and includes more preferably an inorganic laminar compound having aluminum. Also, a surface of the material is preferably treated by a fluorine containing compound. In other words, the surface of the material is preferably bonded by a fluorine compound.

The inventors have found that when the toner includes a polyester resin, fluorine and aluminum and satisfies formulae (1) and (2), the toner has high charging ability, charging stability, low temperature fixing ability, and cleaning reliability.

Inorganic Laminar Compound

The inorganic laminar compound preferably has the fluorine on the surface. The inorganic laminar compound is preferably a modified inorganic laminar compound. The laminar inorganic mineral is a laminar inorganic mineral that is made up of layers with an average thickness of several nanometers that are stacked. Here "modified" means that organic ions are introduced into ions between layers of the laminar inorganic mineral. The "modified" is broadly interpreted as intercalation. JP-A-2003-202708 discloses smectite-group clay minerals (montmorillonite, saponite, and the like), kaolin-group clay minerals (kaolinite and the like), magadiite, and kanemite. Japanese Unexamined Patent Application Publication (Translation of PCT Application) No. 2006-500605, Japanese Unexamined Patent Application Publication (Translation of PCT Application) No. 2006-503313 disclose the modified inorganic laminar compound replaced with organic anions. Hydrotalcite modified by organic anions, one of a laminar double hydroxide, is known as the modified inorganic laminar compound. The modified inorganic laminar compound is high hydrophilic by reason of its modified laminar structures. The shape of toner is not varied if the inorganic laminar compound without modifying is used for the toner made by dispersing and pelletizing in aqueous medium, because the inorganic laminar compound transfer to aqueous medium. However, the shape of toner is varied easily by using the inorganic laminar compound modified by organic ions, because the modified inorganic laminar compound is present much more on the nearby surface of the toner by reason of moderate hydrophoby. And because the modified inorganic laminar compound is dispersed and pelletized, the modified inorganic laminar compound works on charge regulation ability. Because the modified inorganic laminar compound works in small amounts on varying the toner and charge regulation ability, it doesn't inhibit low temperature fixing.

The modified inorganic laminar compound of the present application is preferably a smectite-based material modified with organic cations. The layer of the smectite-based materials charge negatively, and cations are present between layers to set off. Exchanging of those cations and adsorption of a polar molecule depend on forming laminar compound. Metal anions can be introduced to a laminar inorganic mineral by replacing a part of divalent metals with trivalent metals. In this case, since the metal anions have high hydrophilicity, at least a part of the introduced metal anions may be modified with organic anions. This makes the laminar inorganic mineral have moderate hydrophobicity. There is no specific limit to the selection of organic cation modifiers of the laminar inorganic minerals in which at least a portion of the ions between the layers is modified by organic ions as long as the organic modifier modifies the laminar inorganic mineral in such a manner. Specific examples thereof include, but are not limited to, alkyl quaternary ammonium salts, phosphonium salts, and imidazolium salts. Among these, alkyl quaternary ammonium salts are preferable. Specific examples of the alkyl quaternary ammonium salts include, but are not limited to, trimethyl stearyl ammonium, dimethyl stearyl benzil ammonium, oleylbis(2-hydroxyethyl)methyl ammonium.

Besides, the modified inorganic laminar compound is for example kaolinite, laminar phosphate and laminar double hydroxide etc. In this case, the organic ion modifiers are selected in concert with charge of layers. In case layers have negative charge, the above organic ion modifiers are selected. In case layers have positive charge, sulfates, sulfonates, carbonate, and phosphates having branched, non-branched, or cyclic alkyl (C1 to C44), alkenyl (C1 to C22), alkoxy (C8 to C32), hydroxyalkyl (C2 to C22), ethylene-oxide, propylene oxide, etc. Among these, carboxylic acids having an ethylene oxide skeleton are preferable.

By modifying at least a portion of the laminar inorganic compound by organic ions, a suitable hydrophobic property is obtained so that the oil phase containing the toner components have a Non-Newtonian viscosity, thereby deforming the form of the toner. The content of the laminar inorganic compound in which at least a portion of the ions between the layers is modified by organic ions in the toner materials is preferably from 0.05% by weight to 10% by weight and more preferably from 0.05% by weigh to 5% by weigh.

In addition, the laminar inorganic compound in which at least a portion of the ions between the layers is modified by organic ions is suitably selected. Specific examples thereof include, but are not limited to, montmorillonite, bentonite, hectorite, attapulgite, sepiolite, and mixtures thereof. Among these, organic-modified montmorillonite or bentonite is preferable because it is easy to adjust viscosity and demonstrates its effect in a small amount without affecting the toner properties.

Specific examples of the laminar inorganic compound in which at least a portion of the ions between the layers is modified by organic cationic ions include, but are not limited to, quaternium 18 bentonites such as Bentone 3, Bentone 38, and Bentone 38 (manufactured by Rheox Inc.), Tixogel (manufactured by United Catalysts Inc.), and Claytone 34, Claytone 40, and Claytone XL (manufactured by Southern Clay Products Inc.); stearalkonium bentonites such as Tixogel LG (manufactured by United Catalysts Inc.), Claytone AF and Claytone APA (manufactured by Southern Clay Products Inc.); and quaternium 18/benzalkonium bentonites such as Claytone HT and Claytone PS (manufactured by Southern Clay Products Inc.). Among these, Claytone AF and Claytone APA are preferable. Moreover, a more preferred specific example of the laminar inorganic compound in which at least a portion of the ions between the layers is modified by organic anionic ions is a compound obtained by modifying DHT-4A (manufactured by Kyowa Chemical Industry Co., Ltd.) with an organic anion represented by the following Chemical structure 1. A specific example of the organic anion represented by the Chemical structure 1 is HITENOL 330T manufactured by Dai-Ichi Kogyo Seiyaku Co., Ltd.)

$R_1(OR_2)_nOSO_3M$ Chemical structure 1

In Chemical structure 1, $R_1$ represents an alkyl group having 13 carbon atoms, $R_2$ represents an alkylene group having two to six carbon atoms, n represents an integer of from 2 to 100, and M represents a monovalent metal element.

By modifying at least a portion of the laminar inorganic compound by organic ions, a suitable hydrophobic property is obtained so that the oil phase containing the toner components have a Non-Newtonian viscosity, thereby deforming the form of the toner. Besides, the organic ions of the laminar inorganic compound are obtained charging ability and presence on surface of the modified inorganic compound is plenty charging ability.

The surface of the laminar inorganic compound of the present application preferably includes a fluorine compound. The surface of the laminar inorganic compound is preferably treated by the fluorine-containing compound. In other words, the surface of the material is preferably bonded by the fluorine compound.

The fluorine compound preferably has a fluoroalkyl group.

The surface of the laminar inorganic compound of the present application is preferably treated by a coupling agent. The coupling agent can be the fluorine compound if it contains fluorine. The coupling agent is for example silane coupling agent, alumina coupling agent and titanium coupling agent etc. Those coupling agents are organic/inorganic salt of Si, Al and Ti, or organic compound which has at least hydrophobic alkoxyl group, for example alkyl alkoxyl group. Especially the silane coupling agent is prefer.

The silane coupling agent preferably satisfies the following Chemical structure 2.

$RaSiRb_3$ Chemical structure 2

In the Chemical structure 2, Ra represents a hydrocarbon preferably having a fluoromethyl group, which may have functional group. Rb represents hydrolysable group or hydroxyl.

The hydrocarbon is for example saturated or unsaturated aliphatic hydrocarbon group which has linear chain or branched chain, an aromatic hydrocarbon group or an alicyclic ring hydrocarbon group. These carbon hydrocarbons may be monovalent or polyvalent.

The carbon number of the aliphatic hydrocarbon group is preferably 1 to 25, more preferably 1 to 3. The carbon number of the aromatic hydrocarbon group is preferably 6 to 25, more preferably 6 to 10. The carbon number of the alicyclic ring hydrocarbon group is preferably 3 to 25, more preferably 3 to 6. The hydrocarbon group preferably has one or more fluoromethyl groups, more preferably 1 to 3.

In the Chemical structure 2, Rb represents hydrolysable group or hydroxyl. The hydrolysable group is for example alkoxy group, amino group, aminoxy group, amide group and halogen.

The silane coupling agent is for example (Trimethlysily) trifluoromethane, (2,2,2-Trimethlysily)trifluoroethyl, (3,3,3-Trifluoropropyl)trimethoxysilane, (Triethoxysily)trifluoromethane, (2,2,2-Trifluoroethly) triethoxysilane, (3,3,3-Trifluoropropyl) triethoxysilane, 2-ethyl(6,6,6-Trifluorohexyl) trimethoxysilane, 2-hexynl(5,5,5-Trifluorohexyl) trimethoxysilane, p-(Trifluoromethyl) phenyltrifluorosilane etc.

These coupling agents can be used alone or in combination.

The inorganic laminar compound is treated with the coupling agent containing fluorine and the surface of the inorganic laminar compound is thereby covered by a fluorine compound having high polar character. It is included in the toner and as a result the toner has high charging ability.

The inorganic laminar compound treated with a fluorine compound present at the surface of the toner gives a charging ability to the toner. By treating the inorganic laminar compound with the fluorine compound, the fluorine compound present at the surface of the toner is fixed stronger than by treating the surface of the toner with the fluorine compound. High charge ability and charging stability is provided.

Polyester Resin

The polyester resin includes a diol component, or a diol component and a crosslinking component as a constituent component, and preferably includes a dicarboxylic acid.

The polyester resin is preferably a non-crystalline polyester. The diol component contains an aliphatic diol having 3 to 12 carbon atoms in an amount of 50 mol % or more. The diol component contains an aliphatic diol preferably in an amount of 80 mol % or more, and more preferably in an amount of 90 mol % or more.

The non-crystalline polyester resin preferably contains a trihydric or higher alcohol as the crosslink component.

One conceivable method for improving low temperature fixing ability of a toner is lowering the glass transition temperature or the molecular weight of a polyester resin (for example non-crystalline polyester resin) so that the polyester resin melt with a crystalline polyester resin. However, it can easily be imagined that when simply lowering the glass transition temperature or the molecular weight of the polyester resin to lower its melt viscosity, the resultant toner will be degraded in heat resistant storage stability and hot offset resistance upon fixing.

In the toner of the present application, when the polyester resin includes the diol component containing an aliphatic diol having 3 to 12 carbon atoms in an amount of 50 mol % or more is used, the polyester resin has a property of deforming at low temperature since it a very low glass transition temperature. Hence, the polyester resin has such a property that it deforms with heating and pressing upon fixing and easily adheres on recording media such as paper at low temperature. Also, since the polyester resin includes a trihydric or higher alcohol as the crosslink component, the polyester resin has a branched structure in its molecular skeleton, and the molecular chain thereof becomes a three-dimensional network structure. As a result, the polyester resin has such rubber-like properties as to deform at low temperature but not flow, enabling the toner to retain heat resistant storage stability and hot offset resistance.

It is possible to use a trivalent or higher carboxylic acid or an epoxy, however, since many carboxylic acid have aromatic structure and density of ester bond at crosslink part is high, gloss after fixing the toner may be enough. In case using epoxy as the crosslink component, since it is difficult to control distance between crosslink parts, desirable viscous elasticity does not achieve. Besides, since high density parts of crosslink occur easily by reacting with an oligomer which is made at preparing polyester, image unevenness occurs on a fixing image, and gloss and image density may be inferior.

Examples include aliphatic diols having 3 to 12 carbon atoms such as ethylene glycol, 1,2-propylene glycol, 1,3-propylene glycol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol etc.

Among them, aliphatic diols having 4 to 12 carbon atoms are preferred. In addition, the number of carbon atoms of a main chain of the constituent diol component is preferably an odd number and an alkyl group is preferably contained in a side chain. Example includes aliphatic diols having 4 to 12 carbon atoms whose the number of carbon atoms of a main chain of the constituent diol component is an odd number and an alkyl group is contained in a side chain such as aliphatic diols satisfy the following Chemical structure 3.

HO—(CR3R4)*n*-OH Chemical structure 3

In the Chemical structure 3, R3 and R4 independently represent hydrogen or an alkyl group having 1 to 3 carbon atoms. N represents an odd number from 3 to 9. In units of size n, R3 each may be the same or different. In units of size n, R4 each may be the same or different.

The crosslinking component preferably has a trihydric or higher aliphatic alcohol, and more preferably has a trihydric aliphatic alcohol and a quadrivalent aliphatic alcohol in view of gloss of a fixing image and image density. The trihydric or higher aliphatic alcohol may be only used as a crosslink component crosslink component. Examples include a trihydric or higher aliphatic alcohol such as glycerin, trimethylolethane, trimethylolpropane (TMP), pentaerythritol, sorbitol, dipentaerythritol etc.

An amount of the crosslinking component based on the total components of the polyester resin is preferably 0.5% by weight to 5% by weight, more preferably 1% by weight to 3% by weight.

An amount of a trihydric or higher aliphatic alcohol in total multivalent alcohol is preferably 50% by weight to 100% by weight, more preferably 90% by weight to 100% by weight.

The polyester resin preferably includes a dicarboxylic acid component and the dicarboxylic acid component preferably includes 4 to 12 carbon atoms aliphatic dicarboxylic acid.

An amount of 4 to 12 carbon atoms aliphatic dicarboxylic acid in total component of the polyester resin is preferably 50% by weight to 60% by weight.

Examples include 4 to 12 carbon atoms aliphatic dicarboxylic acid such as succinic acid, glutaric acid, adipic acid, pimelic acid, suberic acid, azelaic acid, sebacic acid and decanedioic acid etc.

The polyester resin preferably contains a urethane bond, a urea bond, or both, since it is more excellent in adhesion onto recording media such as paper. Also, as a result of containing a urethane bond, a urea bond, or both in the polyester resin, the urethane bond or the urea bond behaves as a pseudo-crosslinking point to increase rubber-like properties of the polyester resin. As a result, the obtained toner is more excellent in heat resistant storage stability and hot offset resistance.

To prepare polyester resin having at least urethane bond or urea bond, polyester resin is reacted with polyisocyanate. In the present application, reactive product with polyisocyanate is also called modified polyester.

The polyester resin can be used alone or in combination with other polyester resins.

The other polyester resins may/may not include diol component and dicarboxylic acid component. And the other polyester resins may/may not include an aliphatic diol having 3 to 12 carbon atoms and the crosslink component. The other polyester resins may be/may be not a non-modified polyester. The non-modified polyester is not modified polyester by isocyanate etc.

—Diol Component—

Specific examples of the diol include, but are not limited to, aliphatic diols such as ethylene glycol, 1, 2-propylene glycol, 1, 3-propylene glycol, 1, 4-butanediol, and 1, 6-hexanediol, 1, 8-octanediol, 1, 10-decanediol and 1, 12-dodecanediol; diols having an oxy alkylene group such as diethylene glycol, triethylene glycol, dipropylene glycol, polyethylene glycol, polypropylene glycol and polytetramethylene; alicyclic diol such as 1,4-cyclohexanedimethanol and hydrogenated bisphenol A; adducts of the above-mentioned alicyclic diol with an alkylene oxide such as ethylene oxide, propylene oxide and butylene oxide; bisphenols such as bisphenol A, bisphenol F and bisphenol S; and adducts of the above-mentioned bisphenol with an alkylene oxide such as ethylene oxide, propylene oxide and butylene oxide. In particular, aliphatic diols having 4 to 12 carbon atoms are preferably used.

These diols can be used alone or in combination.

—Dicarboxylic Acid Component—

Specific examples of the dicarboxylic acid include, but are not limited to, aliphatic dicarboxylic acids and aromatic dicarboxylic acids. Their anhydrides, lower (having 1 to 3 carbon atoms) alkyl esterified compounds and halogenated compounds may be used. These dicarboxylic acids can be used alone or in combination.

Specific examples of the aliphatic dicarboxylic acids include, but are not limited to, succinic acid, adipic acid, sebacic acid, dodecanedioic acid, maleic acid and fumaric acid.

Specific examples of the aromatic dicarboxylic acid include, but are not limited to, aromatic dicarboxylic acids having 8 to 20 carbon atoms such as phthalic acid, isophthalic acid, terephthalic acid, naphthalene dicarboxylic acid.

Among these, aliphatic dicarboxylic acids having 4 to 12 carbon atoms are preferably used. These may be used alone or in combination.

—Tri- or Higher Valent Alcohol—

The tri- or higher valent alcohol includes, e.g., tri- or higher valent aliphatic alcohol, tri- or higher valent polyphenol and adducts of the tri- or higher valent polyphenol with an alkylene oxide. Specific examples of the tri- or higher valent aliphatic alcohol include, but are not limited to, glycerin, trimethylolethane, trimethylolpropane, pentaerythritol and sorbitol.

Specific examples of the tri- or higher valent polyphenol include, but are not limited to, trisphenol PA, phenolnovolak and cresolnovolak.

Specific examples of the adducts of the tri- or higher valent polyphenol with an alkylene oxide include, but are not limited to, adducts of the tri- or higher valent polyphenol with an alkylene oxide such as ethylene oxide, propylene oxide and butylene oxide.

Among these, trivalent or quadrivalent aliphatic alcohol is preferred. These may be used alone or in combination.

—Polyester Resin Having at Least a Urethane Bond or a Urea Bond—

The polyester resin having at least urethane bond or urea bond is not particularly limited and may be appropriately selected depending on the intended purpose.

Example includes a reactive product between the polyester resin having active hydrogen group and the polyisocyanate. It is a precursor reactive with a curing agent and is called a polyester prepolymer. The polyester resin having at least urethane bond or urea bond may be a reactive product between the reactive product and the curing agent.

Example includes the polyester resin having active hydrogen group such as polyester having hydroxyl group.

—Polyisocyanate—

The polyisocyanate is not particularly limited and may be appropriately selected depending on the intended purpose. Examples thereof include diisocyanate, and trivalent or more isocyanate.

Examples of the diisocyanate include: aliphatic diisocyanate; alicyclic diisocyanate; aromatic diisocyanate; aromatic aliphatic diisocyanate; isocyanurate; and a block product thereof where the foregoing compounds are blocked with a phenol derivative, oxime, or caprolactam.

The aliphatic diisocyanate is not particularly limited and may be appropriately selected depending on the intended purpose. Examples thereof include tetramethylene diisocyanate, hexamethylene diisocyanate, 2,6-diisocyanatomethyl caproate, octamethylene diisocyanate, decamethylene diisocyanate, dodecamethylene diisocyanate, tetradecamethylene diisocyanate, trimethylhexane diisocyanate, and tetramethylhexane diisocyanate.

The alicyclic diisocyanate is not particularly limited and may be appropriately selected depending on the intended purpose. Examples thereof include isophorone diisocyanate, and cyclohexylmethane diisocyanate.

The aromatic diisocyanate is not particularly limited and may be appropriately selected depending on the intended purpose. Examples thereof include tolylene diisocyanate, diisocyanato diphenyl methane, 1,5-nephthylene diisocyanate, 4,4'-diisocyanato diphenyl, 4,4'-diisocyanato-3,3'-dimethyldiphenyl, 4,4'-diisocyanato-3-methyldiphenyl methane, and 4,4'-diisocyanato-diphenyl ether.

The aromatic aliphatic diisocyanate is not particularly limited and may be appropriately selected depending on the intended purpose. Examples thereof include $\alpha,\alpha,\alpha',\alpha'$-tetramethylxylene diisocyanate.

The isocyanurate is not particularly limited and may be appropriately selected depending on the intended purpose. Examples thereof include tris(isocyanatoalkyl)isocyanurate, and tris(isocyanatocycloalkyl)isocyanurate.

These polyisocyanates may be used alone or in combination thereof.

—Curing Agent—

The curing agent is not particularly limited and may be appropriately selected depending on the intended purpose so long as it can react with the non-linear, reactive precursor, and produce the non-crystalline polyester resin A. Examples thereof include an active hydrogen group-containing compound.

—Active Hydrogen Group-Containing Compound—

The active hydrogen group in the active hydrogen group-containing compound is not particularly limited and may be appropriately selected depending on the intended purpose. Examples thereof include a hydroxyl group (e.g., an alcoholic hydroxyl group, and a phenolic hydroxyl group), an amino group, a carboxyl group, and a mercapto group. These may be used alone or in combination thereof.

The active hydrogen group-containing compound is not particularly limited and may be appropriately selected depending on the intended purpose. Amines are preferable as the amines can form a urea bond.

The amines are not particularly limited and may be appropriately selected depending on the intended purpose. Examples thereof include diamine, trivalent or more amine, amino alcohol, amino mercaptan, amino acid, and compounds in which the amino groups of the foregoing compounds are blocked. These may be used alone or in combination thereof. Among them, diamine, and a mixture of diamine and a small amount of trivalent or more amine are preferable.

The diamine is not particularly limited and may be appropriately selected depending on the intended purpose. Examples thereof include aromatic diamine, alicyclic diamine, and aliphatic diamine. The aromatic diamine is not particularly limited and may be appropriately selected depending on the intended purpose. Examples thereof include phenylenediamine, diethyl toluene diamine, and 4,4'-diaminodiphenylethane. The alicyclic diamine is not particularly limited and may be appropriately selected depending on the intended purpose. Examples thereof include 4,4'-diamino-3,3'-dimethyldicyclohexyl methane, diaminocyclohexane, and isophoronediamine. The aliphatic diamine is not particularly limited and may be appropriately selected depending on the intended purpose. Examples thereof include the aliphatic diamine include ethylene diamine, tetramethylene diamine, and hexamethylenediamine.

The trivalent or more amine is not particularly limited and may be appropriately selected depending on the intended purpose. Examples thereof include diethylenetriamine, and triethylene tetramine. The amino alcohol is not particularly limited and may be appropriately selected depending on the intended purpose. Examples thereof include ethanol amine, and hydroxyethyl aniline. The amino mercaptan is not particularly limited and may be appropriately selected depending on the intended purpose. Examples thereof include aminoethyl mercaptan, and aminopropyl mercaptan.

The amino acid is not particularly limited and may be selected depending on the intended purpose. Examples thereof include aminopropionic acid, and aminocaproic acid.

The compound where the amino group is blocked is not particularly limited and may be appropriately selected depending on the intended purpose. Examples thereof include a ketimine compound where the amino group is blocked with ketone such as acetone, methyl ethyl ketone, methyl isobutyl ketone, and an oxazoline compound.

A molecular structure of the polyester resin can be confirmed by solution-state or solid-state NMR, X-ray diffraction, GC/MS, LC/MS, or IR spectroscopy. Simple methods thereof include a method for detecting, as a polyester resin, one that does not have absorption based on δCH(out-of-plane bending vibration) of olefin at 965 $cm^{-1}$±10 $cm^{-1}$ and 990 $cm^{-1}$±10 $cm^{-1}$ in an infrared absorption spectrum.

An amount of the polyester resin is not particularly limited and may be appropriately selected depending on the intended purpose, but it is preferably 50 parts by mass to 90 parts by mass, more preferably 70 parts by mass to 85 parts by mass, relative to 100 parts by mass of the toner. When the amount thereof is less than 50 parts by mass, low temperature fixing ability, and hot offset resistance of a resultant toner may be impaired. When the amount thereof is greater than 90 parts by mass, heat resistant storage stability of the toner may be impaired, and gloss and colorability of an image obtained after fixing may be reduced. When the amount thereof is within the aforementioned more preferable range, it is advantageous to be excellent in low temperature fixing ability, hot offset resistance, and heat resistant storage stability.

Crystalline Polyester Resin

Crystalline polyester resins exhibit heat melting characteristics where it causes drastic viscosity lowering at temperatures around fixing onset temperature, since the crystalline polyester resin has high crystallinity. By using the crystalline polyester resin having these characteristics together with a non-crystallinr polyester resin, the heat resistant storage stability of the toner is excellent up to the melt onset temperature owing to crystallinity, and the toner drastically decreases its viscosity (sharp melt properties) at the melt onset temperature because of melting of the crystalline polyester resin. Along with the drastic decrease in viscosity, the crystalline polyester resin is melt together with the polyester resin, to drastically decrease their viscosity to thereby be fixed. Accordingly, a toner having excellent heat resistant storage stability and low temperature fixing ability can be obtained. Moreover, the toner has excellent results in terms of a releasing width (a difference between the minimum fixing temperature and hot offset occurring temperature).

The crystalline polyester resin is obtained from a polyhydric alcohol and a multivalent carboxylic acid or a derivative thereof such as a multivalent carboxylic acid anhydride and a multivalent carboxylic acid ester.

Note that, in the present application, the crystalline polyester resin is one obtained from a polyhydric alcohol and a multivalent carboxylic acid or a derivative thereof such as a multivalent carboxylic acid anhydride and a multivalent carboxylic acid ester, as described above, and a resin obtained by modifying a polyester resin, for example, the aforementioned prepolymer and a resin obtained through cross-linking and/or chain elongation reaction of the prepolymer do not belong to the crystalline polyester resin.

In the present application, crystallinity of the crystalline polyester resin can be confirmed by a crystal analysis X-ray diffractometer X' Pert Pro MRD from Philips N.V. as follows.

First, a sample is ground in a mortar to prepare a powder thereof. The sample powder is uniformly applied on a sample holder. The sample holder is set in the diffractometer to obtain a diffraction spectrum.

When a peak half width of the maximum peak intensity within a range of the diffraction peaks $20° < 2\theta < 25°$ is not greater than 2.0, the polyester resin is judged to have crystallinity.

A polyester resin having no such a property is called an amorphous polyester resin in the present application.

Conditions of the X-ray diffraction analysis are as follows.

Tension kV: 45 kV
Current: 40 mA
MPSS
Upper
Gonio
Scanmode: continuous
Start angle: 3°
End angle: 35°
Angle Step: 0.02°
Lucident beam optics
Divergence slit: Div slit 1/2

Difflection beam optics
Anti scatter slit: As Fixed 1/2
Receiving slit: Prog rec slit —Polyhydric Alcohol—

The polyhydric alcohol is not particularly limited and may be appropriately selected depending on the intended purpose. Examples thereof include diol, and trihydric or higher alcohol. Examples of the diol include saturated aliphatic diol. Examples of the saturated aliphatic diol include straight chain saturated aliphatic diol, and branched-chain saturated aliphatic diol. Among them, straight chain saturated aliphatic diol is preferable, and C2-C12 straight chain saturated aliphatic diol is more preferable. When the saturated aliphatic diol has a branched-chain structure, crystallinity of the crystalline polyester resin C may be low, and thus may lower the melting point. When the number of carbon atoms in the saturated aliphatic diol is greater than 12, it may be difficult to yield a material in practice. The number of carbon atoms is therefore preferably 12 or less.

Examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, ethylene glycol, 1,4-butanediol, 1,6-hexanediol, 1,8-octanediol, 1,10-decanediol, and 1,12-dodecanediol are preferable, as they give high crystallinity to a resulting crystalline polyester resin C, and give excellent sharp melt properties.

Examples of the trihydric or higher alcohol include glycerin, trimethylol ethane, trimethylolpropane, and pentaerythritol.

These may be used alone or in combination of two or more thereof.

—Multivalent Carboxylic Acid—

The multivalent carboxylic acid is not particularly limited and may be appropriately selected depending on the intended purpose. Examples thereof include divalent carboxylic acid, and trivalent or higher carboxylic acid.

Examples of the divalent carboxylic acid include: saturated aliphatic dicarboxylic acid, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acid of dibasic acid, such as phthalic acid, isophthalic acid, terephthalic acid, naphthalene-2,6-dicarboxylic acid, malonic acid, and mesaconic acid; and anhydrides of the foregoing compounds, and lower (C1-C3) alkyl ester of the foregoing compounds.

Examples of the trivalent or higher carboxylic acid include 1,2,4-benzenetricarboxylic acid, 1,2,5-benzenetricarboxylic acid, 1,2,4-naphthalene tricarboxylic acid, anhydrides thereof, and lower (C1-C3) alkyl esters thereof.

Moreover, the multivalent carboxylic acid may contain, other than the saturated aliphatic dicarboxylic acid or aromatic dicarboxylic acid, dicarboxylic acid containing a sulfonic acid group. Further, the multivalent carboxylic acid may contain, other than the saturated aliphatic dicarboxylic acid or aromatic dicarboxylic acid, dicarboxylic acid having a double bond.

These may be used alone or in combination of two or more thereof.

The crystalline polyester resin is preferably composed of a straight chain saturated aliphatic dicarboxylic acid having 4 to 12 carbon atoms and a straight chain saturated aliphatic diol having 2 to 12 carbon atoms. Specifically, the crystalline polyester resin preferably contains a constituent unit derived from a saturated aliphatic dicarboxylic acid having 4 to 12 carbon atoms, and a constituent unit derived from a saturated aliphatic diol having 2 to 12 carbon atoms. As a result of this, crystallinity increases, and sharp melt properties improve, and therefore it is preferable as excellent low temperature fixing ability of the toner is exhibited.

A melting point of the crystalline polyester resin is not particularly limited and may be appropriately selected depending on the intended purpose, but it is preferably 60° C. to 80° C. When the melting point thereof is lower than 60° C., the crystalline polyester resin tends to be melted at low temperature, which may impair heat resistant storage stability of the toner. When the melting point thereof is higher than 80° C., melting of the crystalline polyester resin with heat applied during fixing may be insufficient, which may impair low temperature fixing ability of the toner.

A molecular weight of the crystalline polyester resin is not particularly limited and may be appropriately selected depending on the intended purpose. Since those having a sharp molecular weight distribution and low molecular weight have excellent low temperature fixing ability, and heat resistant storage stability of a resulting toner lowers as an amount of a low molecular weight component, an o-dichlorobenzene soluble component of the crystalline polyester resin preferably has the weight average molecular weight (Mw) of 3,000 to 30,000, number average molecular weight (Mn) of 1,000 to 10,000, and Mw/Mn of 1.0 to 10, as measured by GPC. Further, it is more preferred that the weight average molecular weight (Mw) thereof be 5,000 to 15,000, the number average molecular weight (Mn) thereof be 2,000 to 10,000, and the Mw/Mn be 1.0 to 5.0.

An acid value of the crystalline polyester resin is not particularly limited and may be appropriately selected depending on the intended purpose, but it is preferably 5 mg KOH/g or higher, more preferably 10 mg KOH/g or higher for achieving the desired low temperature fixing ability in view of affinity between paper and the resin. Meanwhile, the acid value thereof is preferably 45 mg KOH/g or lower for the purpose of improving hot offset resistance.

A hydroxyl value of the crystalline polyester resin is not particularly limited and may be appropriately selected depending on the intended purpose, but it is preferably 0 mg KOH/g to 50 mg KOH/g, more preferably 5 mg KOH/g to 50 mg KOH/g, for achieving the desired low temperature fixing ability and excellent charging properties.

A molecular structure of the crystalline polyester resin can be confirmed by solution-state or solid-state NMR, X-ray diffraction, GC/MS, LC/MS, or IR spectroscopy. Simple methods thereof include a method for detecting, as the crystalline polyester resin, one that has absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the crystalline polyester resin is not particularly limited and may be appropriately selected depending on the intended purpose, but it is preferably 3 parts by mass to 20 parts by mass, more preferably 5 parts by mass to 15 parts by mass, relative to 100 parts by mass of the toner. When the amount thereof is smaller than 3 parts by mass, the crystalline polyester resin does not give sufficient sharp melt properties, which may lead to insufficient low temperature fixing ability of a resulting toner. When the amount thereof is greater than 20 parts by mass, a resulting toner may have low heat resistant storage stability, and tends to cause fogging of an image. When the amount thereof is within the aforementioned more preferable range, it is advantageous because a resulting toner is excellent in terms of both high image quality and low temperature fixing ability.

Other Components

Examples of other components include a release agent, a charge controlling agent, an external additive, a flow improving agent, a cleaning improving agent, and a magnetic material.

—Release Agent—

The release agent is appropriately selected from those known in the art without any limitation.

Examples of wax serving as the release agent include: natural wax, such as vegetable wax (e.g., carnauba wax, cotton wax, Japan wax and rice wax), animal wax (e.g., bees wax and lanolin), mineral wax (e.g., ozokelite and ceresine) and petroleum wax (e.g., paraffin wax, microcrystalline wax and petrolatum).

Examples of the wax other than the above natural wax include synthetic hydrocarbon wax (e.g., Fischer-Tropsch wax and polyethylene wax; and synthetic wax (e.g., ester wax, ketone wax and ether wax).

An amount of the release agent is appropriately selected depending on the intended purpose without any limitation, but it is preferably 2 parts by mass to 10 parts by mass, more preferably 3 parts by mass to 8 parts by mass, relative to 100 parts by mass of the toner.

—Colorant—

A colorant is appropriately selected depending on the intended purpose without any limitation. Examples of the colorant include: black colorant, yellow colorant, magenta colorant and cyan colorant.

An amount of the colorant is not particularly limited and may be appropriately selected depending on the intended purpose, but it is preferably 1 part by mass to 15 parts by mass, more preferably 3 parts by mass to 10 parts by mass, relative to 100 parts by mass of the toner.

The colorant may be used as a master batch in which the colorant forms a composite with a resin. Examples of the binder resin kneaded in the production of, or together with the master batch include, other than the aforementioned polyester resin, polymer of styrene or substitution thereof (e.g., polystyrene, poly-p-chlorostyrene, and polyvinyl).

The master batch can be prepared by mixing and kneading the colorant with the resin for the master batch. In the mixing and kneading, an organic solvent may be used for improving the interactions between the colorant and the resin. Moreover, the master batch can be prepared by a flashing method in which an aqueous paste containing a colorant is mixed and kneaded with a resin and an organic solvent, and then the colorant is transferred to the resin to remove the water and the organic solvent. This method is preferably used because a wet cake of the colorant is used as it is, and it is not necessary to dry the wet cake of the colorant to prepare a colorant.

—Charge Controlling Agent—

The charge controlling agent is appropriately selected depending on the intended purpose without any limitation, and examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives.

An amount of the charge controlling agent is not particularly limited and may be appropriately selected depending on the intended purpose, but it is preferably 0.1 parts by mass to 10 parts by mass, more preferably 0.2 parts by mass to 5 parts by mass, relative to 100 parts by mass of the toner.

—External Additive—

As for the external additive, other than oxide particles, a combination of inorganic particles and hydrophobic-treated inorganic particles can be used. The average primary particle diameter of the hydrophobic-treated particles is preferably 1 nm to 100 nm. More preferred are the inorganic particles of 5 nm to 70 nm.

The external additive is not particularly limited and may be appropriately selected depending on the intended purpose. Examples thereof include silica particles, hydrophobic silica, fatty acid metal salts (e.g., zinc stearate, and aluminum stearate), metal oxide (e.g., titania, alumina, tin oxide, and antimony oxide), and a fluoropolymer.

Hydrophobic silica, titania, titanium oxide and alumina particles are preferred.

An amount of the external additive is not particularly limited and may be appropriately selected depending on the intended purpose, but it is preferably 0.1 parts by mass to 5 parts by mass, more preferably 0.3 parts by mass to 3 parts by mass, relative to 100 parts by mass of the toner.

—Flowability Improving Agent—

The flowability improving agent is not particularly limited and may be appropriately selected depending on the intended purpose so long as it is capable of performing surface treatment of the toner to increase hydrophobicity, and preventing degradations of flow properties and charging properties of the toner even in a high humidity environment. Examples thereof include a silane-coupling agent, a sililation agent, a silane-coupling agent containing a fluoroalkyl group, an organic titanate-based coupling agent, an aluminum-based coupling agent, silicone oil, and modified silicone oil. It is particularly preferred that the silica or titanium oxide be used as hydrophobic silica or hydrophobic titanium oxide treated with the aforementioned flow improving agent.

—Cleanability Improving Agent—

The cleanability improving agent is not particularly limited and may be appropriately selected depending on the intended purpose so long as it can be added to the toner for the purpose of removing the developer remained on a photoconductor or primary transfer member after transferring. Examples thereof include; fatty acid metal salt such as zinc stearate, calcium stearate, and stearic acid; and polymer particles produced by soap-free emulsion polymerization, such as polymethyl methacrylate particles, and polystyrene particles.

—Magnetic Material—

The magnetic material is not particularly limited and may be appropriately selected depending on the intended purpose. Examples thereof include iron powder, magnetite, and ferrite. Among them, a white magnetic material is preferable in terms of a color tone.

<Property of the Toner>

The toner of the present application preferably has the volume average particle diameter of 3 μm to 7 μm and a ratio of the volume average particle diameter to the number average particle diameter of 1.2 or less. The volume average particle diameter of less than 3 μm may cause toner scatter. The volume average particle diameter of more than 7 μm may deteriorate thin line reproducibility.

The toner preferably contains a component having the particle diameter of 2 μm or less in an amount of 10% by number.

Average circularity of the toner particle is preferably 0.925 to 0.980.

Glass transition temperature (Tg1st) of differential scanning calorimetry (DSC) in a first temperature rise is preferably 20° C. to 50° C.

<<Average Particle Diameter>>

In the present application, a volume average particle diameter (Dv) of the toner is preferably 3.0 μm to 7.0 μm. Generally, the smaller the toner is, the higher quality image definition and image quality get. However it works against an ability of transfer and an ability of cleaning. If the volume average particle diameter (Dv) of the toner is smaller than the above range, the toner adherents to a carrier by agitating over a long time in two component developer and a charging ability of the carrier becomes weaker. In the case of a one component toner, the toner adheres to a developing roller and a blade to make a lamina of the toner. Besides, these phenomena relate a content rate of fines of the toner. If the content rate of the toner having diameter less than 2 μm is beyond 20%, these interfere with high charging stability. On another front, if the volume average particle diameter (Dv) of the toner is bigger than the above range, it is difficult to get high quality image definition and high image quality and a fluctuation of the particle diameter of the toner in two component developer probably become big.

A ratio (Dv/Dn) of the volume average particle diameter (Dv) of the toner to a number average particle diameter (Dn) is preferably 1.00 to 1.30 in view of high quality image definition and high image quality. In two component developer, even though the toner is run over a long time, the fluctuation of the particle diameter of the toner in two component developer is low. And even though the toner is agitated in a developing machine, developing ability is good and stabile. If Dv/Dn is beyond 1.3, the fluctuation of the particle diameter of the toner is big and movings of the toner in devepoling etc. are unsynchronized. In the result, reproducibility of micro-dot is lost and high quality image is printed. Dv/Dn is preferably 1.00 to 1.20 and higher quality image is printed.

<<Circularity>>

A ratio of the toner having circularity less than 0.950 in the total toner is preferably 20% to 80% and an average circularity is preferably 0.925 to 0.980, since in the case almost toners have small diameter it is difficult to clean.

At first, a relation between shape of toner and transferring ability is explained. In the case of full color copying machine, an amount of the toner on an image bearer increases than black-and-white copying machine. And prior indefinite shape toner is difficult to improve transferring ability. Besides, in the case of using indefinite shape toner, transferring ability go down by adherences and filmings on the image bearer and the intermediate transfer belt occurred by rubbing power between the image bearer and the cleaning member, between the intermediate transfer belt and the cleaning member and between the image bearer and the intermediate transfer belt. In the case of full color copying machine, four colors is not transferred evenly and in the case of using intermediate transfer belt it occurs color unevenness and problem of color valance. In the result, it is difficult to print high quality color image.

In view of balance of blade cleaning and transfer efficiency, to satisfy the ratio of the toner having circularity less than 0.950 in the total toner is 20% to 80%, cleaning ability and transfer ability are achieved. Cleaning ability and transfer ability relate a material of the blade and contact conditions of the blade. Besides, since transferring is depend on process conditions, architectonics can apply process conditions in above range. However, if the ratio of the toner having circularity less than 0.950 in the total toner is under 20%, it is difficult to clean by the blade. When the ratio of the toner having circularity less than 0.950 in the total toner is beyond 80%, transferring ability goes down. Because the shape of the toner is deformed too much, moving of the toner (image bearer-transfer paper, image bearer-intermediate transfer belt and first transfer belt-second transfer belt) are not smooth and movings of each toner are unsynchronized.

Lack of charging stability and frailty of particles also occur. Then the toner is finely divided in two-component developer and it occurs debasing durability of two-component developer.

<<Glass Transition Temperature>>

The glass transition temperature (Tg1st) of the toner is preferably 0° C. to 50° C., where the glass transition temperature (Tg1st) is measured in first heating of differential scanning calorimetry (DSC).

If the Tg of a conventional toner is lowered to be about 50° C. or lower, the conventional toner tends to cause aggregation of toner particles influenced by temperature variations during transportation or storage of the toner in summer or in a tropical region. As a result, the toner is solidified in a toner bottle, or within a developing unit. Moreover, supply failures due to clogging of the toner in the toner bottle, and formation of defected images due to toner adherence are likely to occur.

The toner preferably has a lower Tg than conventional toners. When the non-crystalline polyester resin A, which is a low Tg component in a toner, is non-linear, the toner can maintain its heat resistant storage stability. In particular, in cases where the polyester resin has a urethane bond or a urea bond responsible for high aggregation force, the effect of retaining heat resistant storage stability is more significant.

A glass transition temperature (Tg2nd), where the glass transition temperature (Tg2nd) is measured in the second heating in differential scanning calorimetry (DSC) of the toner, is preferably 0° C. to 30° C., more preferably 10° C. to 30° C.

A difference (Tg1st−Tg2nd) between the glass transition temperature (Tg1st) of the toner as measured in the first heating in differential scanning calorimetry (DSC) and the glass transition temperature (Tg2nd) of the toner as measured in the second heating in DSC is not particularly limited and may be appropriately selected depending on the intended purpose, but it is preferably beyond 0° C., more preferably 10° C. or greater. The upper limit of the difference is not particularly limited and may be appropriately selected depending on the intended purpose, but it is preferably 50.degree. C. or less.

When the toner of the present application includes crystalline polyester, the crystalline polyester and non-crystalline polyester become a compatible state after heating (after the first heating) though they are non-compatible state before heating (before the first heating).

When the Tg1st is under 20° C., heat resistant storage stability, blocking in a developing unit and filmings on an image bearer occur. When the Tg1st is beyond 50° C., low temperature fixing ability become down.

When the Tg2st is under 0° C., blocking resistance of a fixing image become down. When the Tg2st is beyond 30° C., low temperature fixing ability and gloss is not achieved.

<Calculation Methods and Analysis Methods of Various Properties of Toner and Constituent Component of Toner>

The Tg, acid value, hydroxyl value, molecular weight, and melting point of the polyester resin, the crlstalline polyester and the release agent may be each measured. Alternatively, each component may be separated from an actual toner by gel permeation chromatography (GPC) or the like, and separated each component may be subjected to the analysis methods described later, to thereby calculate Tg, molecular weight, melting point, and mass ratio of a constituent component.

Separation of each component by GPC can be performed, for example, by the following method.

In GPC using THF (tetrahydrofuran) as a mobile phase, an eluate is subjected to fractionation by a fraction collector, a fraction corresponding to a part of a desired molecular weight is collected from a total area of an elution curve. The collected eluates are concentrated and dried by an evaporator or the like, and a resultant solid content is dissolved in a deuterated solvent, such as deuterated chloroform, and deuterated THF, followed by measurement of .sup.1H-NMR. From an integral ratio of each element, a ratio of a constituent monomer of the resin in the elution composition is calculated.

As another method, after concentrating the eluate, hydrolysis is performed with sodium hydroxide or the like, and a ratio of a constituent monomer is calculated by subjecting the decomposed product to a qualitative or quantitative analysis by high performance liquid chromatography (HPLC).

Note that, in the case where the method for producing a toner produces toner base particles by generating the polyester resin through a chain-elongation reaction and/or cross-linking reaction of the non-linear chain reactive precursor and the curing agent, the polyester resin may be separated from an actual toner by GPC or the like, to thereby determine Tg thereof. Alternatively, the polyester resin is separately generated through a chain-elongation reaction and/or cross-linking reaction of the non-linear chain reactive precursor and the curing agent, and Tg may be measured on the synthesized polyester resin.

<<Separation Method of Toner Constituent Components>>

An example of a separation method of each component during analysis of the toner will be specifically described hereinafter.

First, 1 g of a toner is added to 100 mL THF, and the resulting mixture is stirred for 30 minutes at 25° C., to thereby a solution in which soluble components are dissolved.

The solution is then filtered through a membrane filter having an opening of 0.2 μm, to thereby obtain the THF soluble components in the toner.

Next, the THF soluble components are dissolved in THF, to thereby prepare a sample for measurement of GPC, and the prepared sample is supplied to GPC used for molecular weight measurement of each resin mentioned above.

Meanwhile, a fraction collector is disposed at an eluate outlet of GPC, to fraction the eluate per a certain count. The eluate is obtained per 5% in terms of the area ratio from the elution onset on the elution curve (raise of the curve).

Next, each eluted fraction, as a sample, in an amount of 30 mg is dissolved in 1 mL of deuterated chloroform, and to this solution, 0.05% by volume of tetramethyl silane (TMS) is added as a standard material.

A glass tube for NMR having a diameter of 5 mm is charged with the solution, from which a spectrum is obtained by means of a nuclear magnetic resonance apparatus (JNM-AL 400, manufactured by JEOL Ltd.) by performing multiplication 128 times at temperature of 23° C. to 25° C.

The monomer compositions and the compositional ratios of the polyester resin, the crystalline polyester resin, and the like contained in the toner are determined from peak integral ratios of the obtained spectrum.

For example, an assignment of a peak is performed in the following manner, and a constituent monomer component ratio is determined from each integral ratio.

The assignment of a peak is as follows:

Around 8.25 ppm: derived from a benzene ring of trimellitic acid (for one hydrogen atom)

Around the region of 8.07 ppm to 8.10 ppm: derived from a benzene ring of terephthalic acid (for four hydrogen atoms)

Around the region of 7.1 ppm to 7.25 ppm: derived from a benzene ring of bisphenol A (for four hydrogen atoms)

Around 6.8 ppm: derived from a benzene ring of bisphenol A (for four hydrogen atoms), and derived from a double bond of fumaric acid (for two hydrogen atoms)

Around the region of 5.2 ppm to 5.4 ppm: derived from methine of bisphenol A propylene oxide adduct (for one hydrogen atom)

Around the region of 3.7 ppm to 4.7 ppm: derived from methylene of a bisphenol A propylene oxide adduct (for two hydrogen atoms), and derived from methylene of a bisphenol A ethylene oxide adduct (for four hydrogen atoms)

Around 1.6 ppm: derived from a methyl group of bisphenol A (for six hydrogen atoms).

From these results, for example, the extracted product collected in the fraction in which the polyester resin contains 90% by mass or more can be treated as the polyester resin.

Similarly, the extracted product collected in the fraction in which the crystalline polyester resin contains 90% by mass or more can be treated as the crystalline polyester resin.

<<Measurement Methods of Melting Point and Glass Transition Temperature (Tg)>>

In the present application, a melting point and a glass transition temperature (Tg) can be measured, for example, by means of a differential scanning calorimeter (DSC) system (Q-200, manufactured by TA Instruments Japan Inc.).

Specifically, the melting point and the glass transition temperature of a samples are measured in the following manners.

Specifically, first, an aluminum sample container charged with about 5.0 mg of a sample is placed on a holder unit, and the holder unit is then set in an electric furnace. Next, the sample is heated (first heating) from −80.degree. C. to 150.degree. C. at the heating rate of 10.degree. C./min in a nitrogen atmosphere. Then, the sample is cooled from 150.degree. C. to −80.degree. C. at the cooling rate of 10.degree. C./min, followed by again heating (second heating) to 150.degree. C. at the heating rate of 10.degree. C./min. DSC curves are respectively measured for the first heating and the second heating by means of a differential scanning calorimeter (Q-200, manufactured by TA Instruments Japan Inc.).

The DSC curve for the first heating is selected from the obtained DSC curve by means of an analysis program stored in the Q-200 system, to thereby determine a glass transition temperature of the sample with the first heating. Similarly, the DSC curve for the second heating is selected, and the glass transition temperature of the sample with the second heating can be determined.

Moreover, the DSC curve for the first heating is selected from the obtained DSC curve by means of the analysis program stored in the Q-200 system, and an endothermic peak top temperature of the sample for the first heating is determined as a melting point of the sample. Similarly, the DSC curve for the second heating is selected, and the endothermic peak top temperature of the sample for the second heating can be determined as a melting point of the sample with the second heating.

In the case where a toner is used as a sample, glass transition temperature for the first heating is represented as Tg1st, and glass transition temperature for the second heating is represented as Tg2nd in the present specification.

Also in the present application, regarding the Tg and the melting point of the polyester resin, the crystalline polyester resin, and the other constituent components such as the release agent, the endothermic peak top temperature and the Tg in the second heating are defined as the melting point and the Tg of each of the target samples, respectively, unless otherwise specified.

<<Measurement Methods of Particle Size Distribution>>

The volume average particle diameter (Dv) and the number average particle diameter (Dn) of the toner of the present application can be determined by, for example, measuring with a granulometer ("MULTISIZER III", manufactured by Beckman Coulter, Inc.) at an aperture diameter of 100 μm and then analyzing with an analyzing software (Beckman Coulter Mutlisizer 3 Version3.51). Specifically, 0.5 mL of a 10% by mass surfactant (alkylbenzene sulfonate NEOGEN SC-A, manufactured by DKS Co. Ltd.) is added to a 100 mL glass beaker. Then, 0.5 g of the toner is added thereto, followed by stirring with a microspartel, and then adding with 80 mL of ion exchanged water. The thus obtained dispersion liquid was dispersed with an ultrasonic disperser (W-113MK-II, manufactured by HONDA ELECTRONICS CO., LTD.) for 10 min.

Next, the dispersion liquid is measured using the MULTISIZER III and ISOTON III (manufactured by Beckman Coulter, Inc.) as a solution for measurement. The dispersion liquid of toner sample is added dropwise so that a concentration thereof indicated by the MULTISIZER III is 8±2%. In this measurement, it is important to control the concentration of the dispersion liquid of toner sample to 8±2% from the viewpoint of measurement reproducibility of the particle diameter. The concentration falling within the above range is less likely to cause error with respect to particle diameter.

<<Average Circularity>>

The average circularity of the toner can be determined by measuring with a flow type particle image analyzer ("FPIA-2000", manufactured by Toa Medical Electronics Co., Ltd.). 0.1 mL to 0.5 mL of surfactant, preferably alkylbenzene sulfonate, as a dispersant is added in 100 mL to 150 mL of water removed an impurity and 0.1 g to 0.5 g of a measurement sample is added in the water. The thus obtained suspension liquid is dispersed with an ultrasonic disperser for about 1 min to 3 min. And the average circularity of the toner can be determined by measuring the shape of the toner and particle size distribution of the toner from 3000 particle/μL to 10000 particle/μL concentration of the dispersion liquid with FPIA-2000.

<<Measurement of Molecular Weight>>

The molecular weight of each of the constituent components of the toner can be measured by the following method, for example.

Gel permeation chromatography (GPC) measuring apparatus: GPC-8220 GPC (product of TOSOH CORPORATION)

Column: TSKgel Super HZM-H 15 cm, 3 columns connected (product of TOSOH CORPORATION)

Temperature: 40.degree. C.

Solvent: THF

Flow rate: 0.35 mL/min

Sample: 0.15% by mass sample (100 .mu.L) applied

Pretreatment of sample: The toner is dissolved in tetrahydrofuran (THF) (containing a stabilizer, product of Wako Pure Chemical Industries, Ltd.) in a concentration of 0.15% by mass, and the solution is filtrated with a 0.2-.mu.m filter. The resultant filtrate is used as a sample. This THF sample solution (100 .mu.L) is applied for measurement.

In the measurement of the molecular weight of the sample, the molecular weight distribution of the sample is determined based on the relationship between the logarithmic value and the count number of a calibration curve given by using several monodisperse polystyrene-standard samples. The standard polystyrene samples used for giving the calibration curve are Showdex STANDARD Std. Nos. S-7300, S-210, S-390, S-875, S-1980, S-10.9, S-629, S-3.0 and S-0.580 (these products are of SHOWA DENKO K.K.). The detector used is a refractive index (RI) detector.

<<Measurement of Hydroxyl Number and Acid Number>>

Hydroxyl number can be measured by the method implemented in relation to JIS K0070-1966.

Acid number can be measured by the method implemented in relation to JIS K0070-1992.

<<Energy Dispersive X-Ray Spectrometry and Evaluation of Distribution>>

Analysis of F atoms and Al atoms on the surface of the toner can be measured by energy dispersive X-ray spectrometry (EDS) in the following manner, which is understood by those of ordinary skill in the EDS technique.

A duplicative image area is calculated by extraction F atoms distribution image and Al atoms distribution images with an image-editing software.

Distribution of every kind of atoms on the surface of the toner can be measured by energy dispersive X-ray spectrometry (EDS) attached with a scanning electron microscope (SEM). Voluntary atom can be detected by EDS atom mapping using SEM and distribution is judged by the obtained image.

Figure 2:
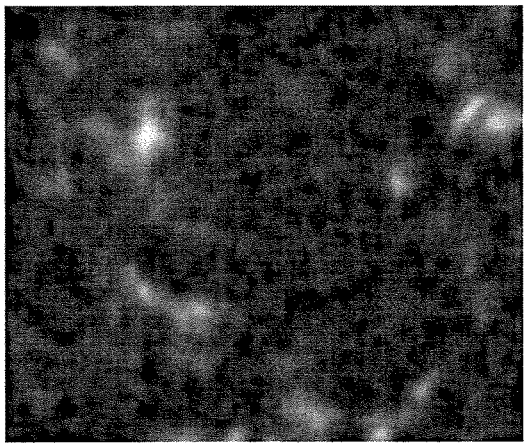
FIG. 2 is an image showing presence of Aluminum of EDS of one example of a toner of the present application.
Figure 3:
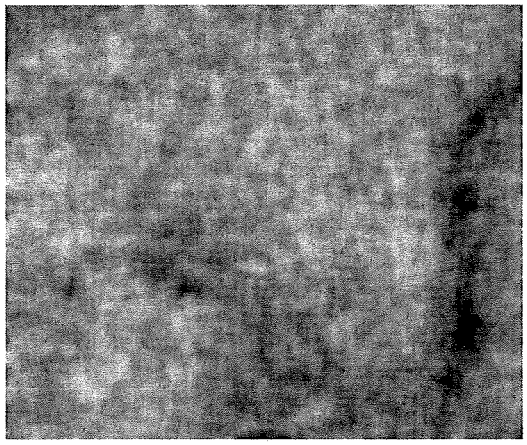
FIG. 3 is an image showing presence of fluorine of EDS of one example of a toner of the present application.
Figure 4:
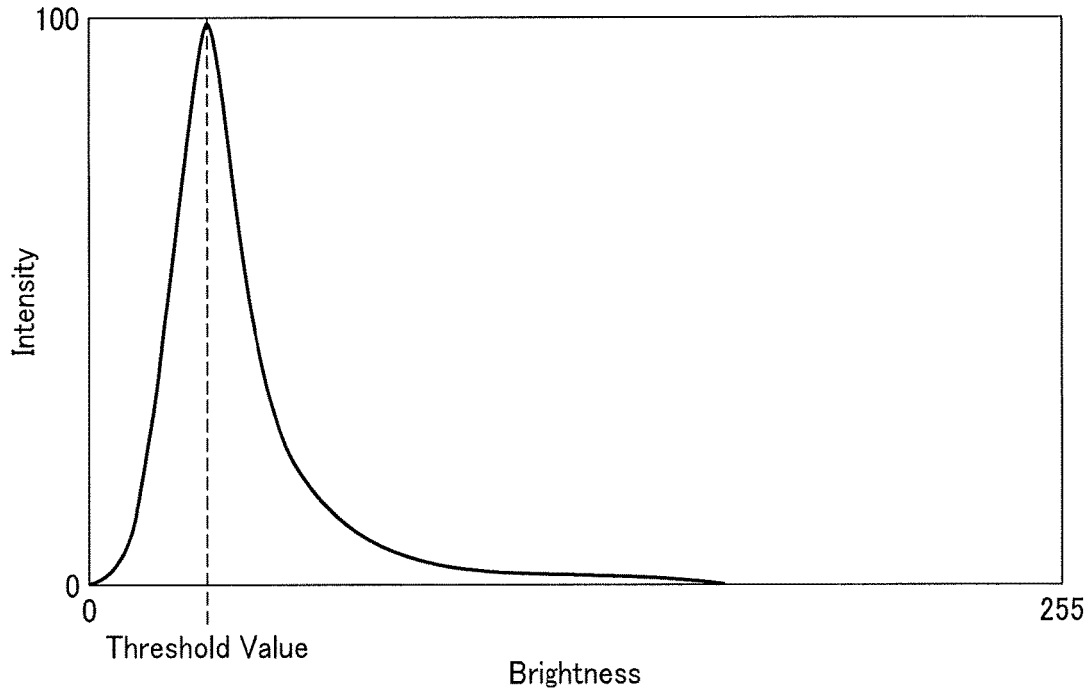
FIG. 4 is an explanation drawing of threshold value to digitize an image of presence of an atom based on a data of EDS.
Figure 5:
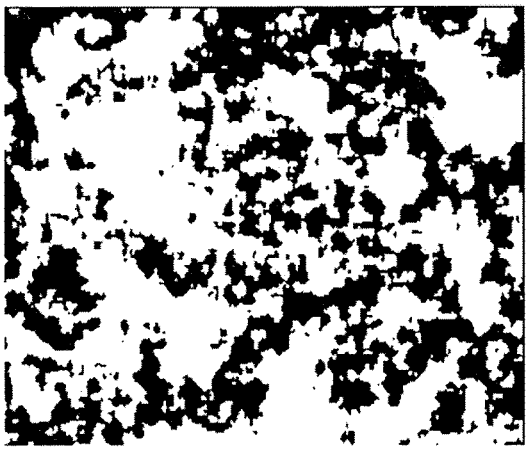
FIG. 5 is an image showing presence of Aluminum digitized to the image of FIG. 2.
Figure 6:
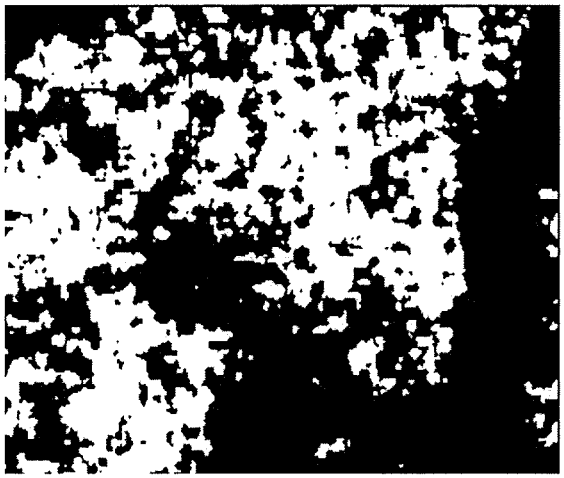
FIG. 6 is an image showing presence of fluorine digitized to the image of FIG. 3.
Figure 7:
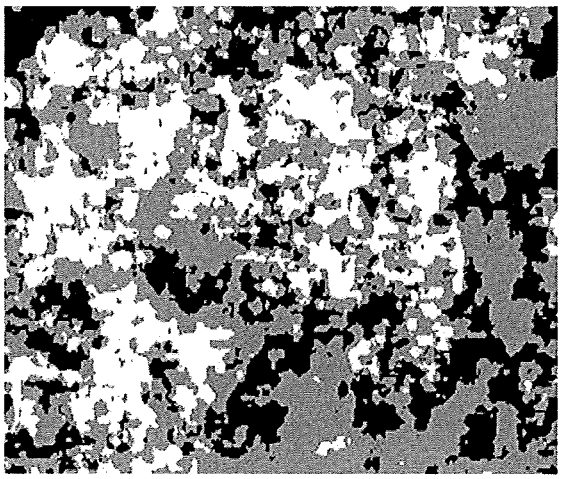
FIG. 7 is an image of an area overlapping between aluminum and fluorine of one example of a toner of the present application.

In practice, the surface of the toner was shot, enlarging 10000 times, using a field emission-type scanning electron microscope ("ULTRA55", manufactured by Carl Zeiss) (FIG. 1). Information on atoms was obtained by attached EDS and distribution images of F atom and Al atom were obtained (FIG. 2 and FIG. 3). After the distribution image of each atom was made into a gray scale image, the most frequent brightness on brightness distribution of the gray scale image was regarded as a threshold value (FIG. 4). And then a binary image was made as brighter parts in areas of existing atoms (FIG. 5 and FIG. 6), and the area was calculated. White parts in FIG. 5 represent existing Al and black parts in FIG. 5 represent non-existing Al. White parts in FIG. 6 represent existing F and black parts in FIG. 5 represent non-existing F. The duplicative image area is calculated from these both images with the image-editing software. White parts in FIG. 7 represent existing both F and Al. Gray parts in FIG. 7 represent areas in which only F or only Al exist. Black parts in FIG. 7 represent areas of non-existing F and Al.

Thus the area of existing F (A), the area of existing Al (B) and the area of existing both F and Al (AB) were obtained.

<Production Method for the Toner>

A production method for the toner is not particularly limited and may be appropriately selected depending on the intended purpose. Preferably, the toner is granulated by dispersing an oil phase in an aqueous medium, where the oil phase contains a polyester resin and a colorant, if necessary, further contains the release agent, and the like.

Also, more preferably, the toner is granulated by dispersing an oil phase in an aqueous medium, where the oil phase contains a polyester resin containing at least one of a urethane bond and a urea bond; and a polyester resin not containing urethane bond and urea bond; preferably contains the crystalline polyester resin; and if necessary, further contains the release agent and the colorant.

As one example of such a production method of the toner, a conventionally dissolution suspension method is listed.

As one example of the production method of the toner, a method for forming toner base particles while extending the polyester resin through a chain-elongation reaction and/or cross-linking reaction between the prepolymer and the curing agent will be described hereinafter. In such a method, a preparation of an aqueous medium, preparation of an oil phase containing a toner material, emulsification and/or dispersion of the toner material, and removal of an organic solvent are carried out.

—Surface Treating of the Inorganic Laminar Compound—

The surface treating of the inorganic laminar compound can be selected among dry-type and wet-type. In the dry-type, the inorganic laminar compound is agitated with a blender etc. and mixed with a coupling agent by spraying or dripping. After that, it was dried by superheating. In the wet-type, the inorganic laminar compound is slurried and mixed with a coupling agent. And it is agitated, percolated and dried.

The wet-type is preferred to treat on the surface of the inorganic laminar compound uniformly. In the wet-type, water, acid water which pH is controlled by acetic acid etc., alcohol and combination of these is used as a solvent. The inorganic laminar compound is agitated in the solvent and is slurried. And then the coupling agent including a fluorine compound is added there, percolated and dried.

Thus the surface of the inorganic laminar compound which is treated with a fluorine compound and is bonded to a fluorine compound, is obtained.

—Preparation of Aqueous Medium (Aqueous Phase)—

The preparation of the aqueous phase can be carried out, for example, by dispersing resin particles in an aqueous medium. An amount of the resin particles in the aqueous medium is not particularly limited and may be appropriately selected depending on the intended purpose, but it is preferably 0.5 parts by mass to 10 parts by mass relative to 100 parts by mass of the aqueous medium.

The aqueous medium is not particularly limited and may be appropriately selected depending on the intended purpose. Examples thereof include water, a solvent miscible with water, and a mixture thereof. These may be used alone or in combination. Among them, water is preferable.

The solvent miscible with water is not particularly limited and may be appropriately selected depending on the intended purpose. Examples thereof include alcohol, dimethyl formamide, tetrahydrofuran, cellosolve, and lower ketone. The alcohol is not particularly limited and may be appropriately selected depending on the intended purpose. Examples thereof include methanol, isopropanol, and ethylene glycol. The lower ketone is not particularly limited and may be appropriately selected depending on the intended purpose. Examples thereof include acetone and methyl ethyl ketone.

—Preparation of Oil Phase—

The oil phase containing the toner materials can be prepared by dissolving or dispersing toner materials in an organic solvent, where the toner materials contain: a polyester resin which is a prepolymer containing at least one of a urethane bond and a urea bond; a polyester resin which does not contain a urethane bond and a urea bond; the crystalline polyester resin; a colorant; and a colorant dispersing resin, and if necessary, further contains the curing agent, the release agent, the colorant, etc.

The organic solvent is not particularly limited and may be appropriately selected depending on the intended purpose, but it is preferably an organic solvent having a boiling point of lower than 150° C., as removal thereof is easy.

The organic solvent having the boiling point of lower than 150.degree. C. is not particularly limited and may be appropriately selected depending on the intended purpose. Examples thereof include liphopholic solvents such as toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, and ethyl acetate; and hydrophilic solvents such as methyl ethyl ketone, and methyl isobutyl ketone. These may be used alone or in combination of two or more thereof.

Among them, ethyl acetate, toluene, xylene, benzene, methylene chloride, 1,2-dichloroethane, chloroform, and carbon tetrachloride are particularly preferable, and ethyl acetate is more preferable.

—Emulsification or Dispersion—

The emulsification or dispersion of the toner materials can be carried out by dispersing the oil phase containing the toner materials in the aqueous medium. In the course of the emulsification or dispersion of the toner material, the curing agent and the prepolymer are allowed to carry out a chain-elongation reaction or cross-linking reaction.

The reaction conditions (e.g., the reaction time and reaction temperature) for generating the prepolymer are not particularly limited and may be appropriately selected depending on a combination of the curing agent and the prepolymer.

The reaction time is not particularly limited and may be appropriately selected depending on the intended purpose, but it is preferably 10 minutes to 40 hours, more preferably 2 hours to 24 hours.

The reaction temperature is not particularly limited and may be appropriately selected depending on the intended purpose, but it is preferably 0° C. to 150° C., more preferably 40° C. to 98° C.

A method for stably forming dispersion liquid in the aqueous medium is not particularly limited and may be appropriately selected depending on the intended purpose. Examples thereof include a method in which an oil phase, which has been prepared by dissolving and/or dispersing a toner material in a solvent, is added to a phase of an aqueous medium, followed by dispersing with shear force.

A disperser used for the dispersing is not particularly limited and may be appropriately selected depending on the intended purpose. Examples thereof include a low-speed shearing disperser, a high-speed shearing disperser, a friction disperser, a high-pressure jetting disperser and an ultrasonic wave disperser.

Among them, the high-speed shearing disperser is preferable, because it can control the particle diameters of the dispersed elements (oil droplets) to the range of 2 μm to 20 μm.

In the case where the high-speed shearing disperser is used, the conditions for dispersing, such as the rotating speed, dispersion time, and dispersion temperature, may be appropriately selected depending on the intended purpose.

The rotational speed is not particularly limited and may be appropriately selected depending on the intended purpose, but it is preferably 1,000 rpm to 30,000 rpm, more preferably 5,000 rpm to 20,000 rpm.

The dispersion time is not particularly limited and may be appropriately selected depending on the intended purpose, but it is preferably 0.1 minutes to 5 minutes in case of a batch system.

The dispersion temperature is not particularly limited and may be appropriately selected depending on the intended purpose, but it is preferably 0° C. to 150.° C., more preferably 40.° C. to 98° C. under pressure. Note that, generally speaking, dispersion can be easily carried out, as the dispersion temperature is higher.

An amount of the aqueous medium used for the emulsification or dispersion of the toner material is not particularly limited and may be appropriately selected depending on the intended purpose, but it is preferably 50 parts by mass to 2,000 parts by mass, more preferably 100 parts by mass to 1,000 parts by mass, relative to 100 parts by mass of the toner material.

When the amount of the aqueous medium is smaller than 50 parts by mass, the dispersion state of the toner material is impaired, which may result a failure in attaining toner base particles having desired particle diameters. When the amount thereof is greater than 2,000 parts by mass, the production cost may increase.

When the oil phase containing the toner material is emulsified or dispersed, a dispersant is preferably used for the purpose of stabilizing dispersed elements, such as oil droplets, and gives a shape particle size distribution as well as giving desirable shapes of toner particles.

The dispersant is not particularly limited and may be appropriately selected depending on the intended purpose. Examples thereof include a surfactant, a water-insoluble inorganic compound dispersant, and a polymer protective colloid. These may be used alone or in combination of two or more thereof. Among them, the surfactant is preferable.

The surfactant is not particularly limited and may be appropriately selected depending on the intended purpose. Examples thereof include an anionic surfactant, a cationic surfactant, a nonionic surfactant, and an amphoteric surfactant.

The anionic surfactant is not particularly limited and may be appropriately selected depending on the intended purpose. Examples thereof include alkyl benzene sulfonic acid salts, .alpha.-olefin sulfonic acid salts and phosphoric acid esters. Among them, those having a fluoroalkyl group are preferable.

—Removal of Organic Solvent—

A method for removing the organic solvent from the dispersion liquid such as the emulsified slurry is not particularly limited and may be appropriately selected depending on the intended purpose Examples thereof include; a method in which an entire reaction system is gradually heated to evaporate out the organic solvent in the oil droplets; and a method in which the dispersion liquid is sprayed in a dry atmosphere to remove the organic solvent in the oil droplets.

As the organic solvent removed, toner base particles are formed. The toner base particles can be subjected to washing and drying, and can be further subjected to classification. The classification may be carried out in a liquid by removing small particles by cyclone, a decanter, or centrifugal separator, or may be performed on particles after drying.

The obtained toner base particles may be mixed with particles such as the external additive, and the charge controlling agent. By applying a mechanical impact during the mixing, the particles such as the external additive can be prevented from fall off from surfaces of the toner base particles.

A method for applying the mechanical impact is not particularly limited and may be appropriately selected depending on the intended purpose. Examples thereof include; a method for applying impulse force to a mixture by a blade rotating at high speed; a method for adding a mixture into a high-speed air flow and accelerating the speed of the flow to thereby make the particles crash into other particles, or make the composite particles crush into an appropriate impact board.

A device used for this method is appropriately selected depending on the intended purpose without any limitation, and examples thereof include ANGMILL (product of Hosokawa Micron Corporation), an apparatus produced by modifying I-type mill (product of Nippon Pneumatic Mfg. Co., Ltd.) to reduce the pulverizing air pressure, a hybridization system (product of Nara Machinery Co., Ltd.), a kryptron system (product of Kawasaki Heavy Industries, Ltd.) and an automatic mortar.

(Developer)

A developer of the present application contains at least the toner, and may further contain appropriately selected other components, such as carrier, if necessary.

Accordingly, the developer has excellent transfer properties, and charging ability, and can stably form high quality images. Note that, the developer may be a one-component developer, or a two-component developer, but it is preferably a two-component developer when it is used in a high speed printer corresponding to recent high information processing speed, because the service life thereof can be improved.

In the case where the developer is used as a one-component developer, the diameters of the toner particles do not vary largely even when the toner is supplied and consumed repeatedly, the toner does not cause filming to a developing roller, nor fuse to a layer thickness regulating member such as a blade for thinning a thickness of a layer of the toner, and provides excellent and stable developing ability and image even when it is stirred in the developing device over a long period of time.

In the case where the developer is used as a two-component developer, the diameters of the toner particles in the developer do not vary largely even when the toner is supplied and consumed repeatedly, and the toner can provide excellent and stabile developing ability even when the toner is stirred in the developing device over a long period of time.

<Carrier>

The carrier is appropriately selected depending on the intended purpose without any limitation, but it is preferably an earner containing a core, and a resin layer covering the core. (Toner Stored Unit)

A toner stored unit of the present application stores a toner in a unit having a function of storing the toner. Here, aspects of the toner stored unit are, for example, a toner stored container, a developing device, and a process cartridge.

The toner stored container is a container storing a toner.

The developing device includes a unit storing a toner, and configured to perform development.

The process cartridge integrally includes an image bearer and a developing unit, stores a toner, and is detachable to an image forming apparatus. The process cartridge may further include at least one selected from the group consisting of a charging unit, an exposing unit, and a cleaning unit.

A toner stored unit of the present application is mounted on an image forming apparatus to form an image, and thus a toner of the present application is used to form an image, which can lead to excellence in high charging ability, charging stability, low temperature fixing ability and cleaning reliability. As the result, it can lead to excellence in long-term image stability, high quality image and high definition image.

(Image Forming Apparatus and Image Forming Method)

An image forming apparatus of the present application includes at least an electrostatic latent image bearing member (hereinafter may be referred to as "photoconductor"), an electrostatic latent image forming unit, and a developing unit; and, if necessary, further includes other units.

An image forming method of the present application includes at least an electrostatic latent image forming step and a developing step; and, if necessary, further includes other steps.

The image forming method can be suitably performed by the image forming apparatus of the present application. Specifically, the electrostatic latent image forming step can be suitably performed by the electrostatic latent image forming unit. The developing step can be suitably performed by the developing unit. The other steps can be suitably performed by the other units.

<Electrostatic Latent Image Bearer>

The material, structure and size of the electrostatic latent image bearer are not particularly limited and may be appropriately selected depending on the intended purpose. Examples of the material thereof include inorganic photoconductors such as amorphous silicon and selenium and organic photoconductors such as polysilane and phthalopolymethine.

<Electrostatic Latent Image Forming Unit>

The electrostatic latent image forming unit is not particularly limited and may be appropriately selected depending on the intended purpose so long as it is a unit configured to form an electrostatic latent image on the electrostatic latent image bearer. Examples thereof include a unit including at least a charging member configured to charge a surface of the electrostatic latent image bearer and an exposing member configured to imagewise expose the surface of the electrostatic latent image bearer to light.

<Developing Unit>

The developing unit is not particularly limited and may be appropriately selected depending on the intended purpose so long as it is a developing unit containing a toner for developing the electrostatic latent image formed on the electrostatic latent image bearer to thereby form a visible image.

<Other Units>

Examples of the other units include a transfer unit, a fixing unit, a cleaning unit, a charge-eliminating unit, a recycling unit, and a controlling unit.

Figure 8:
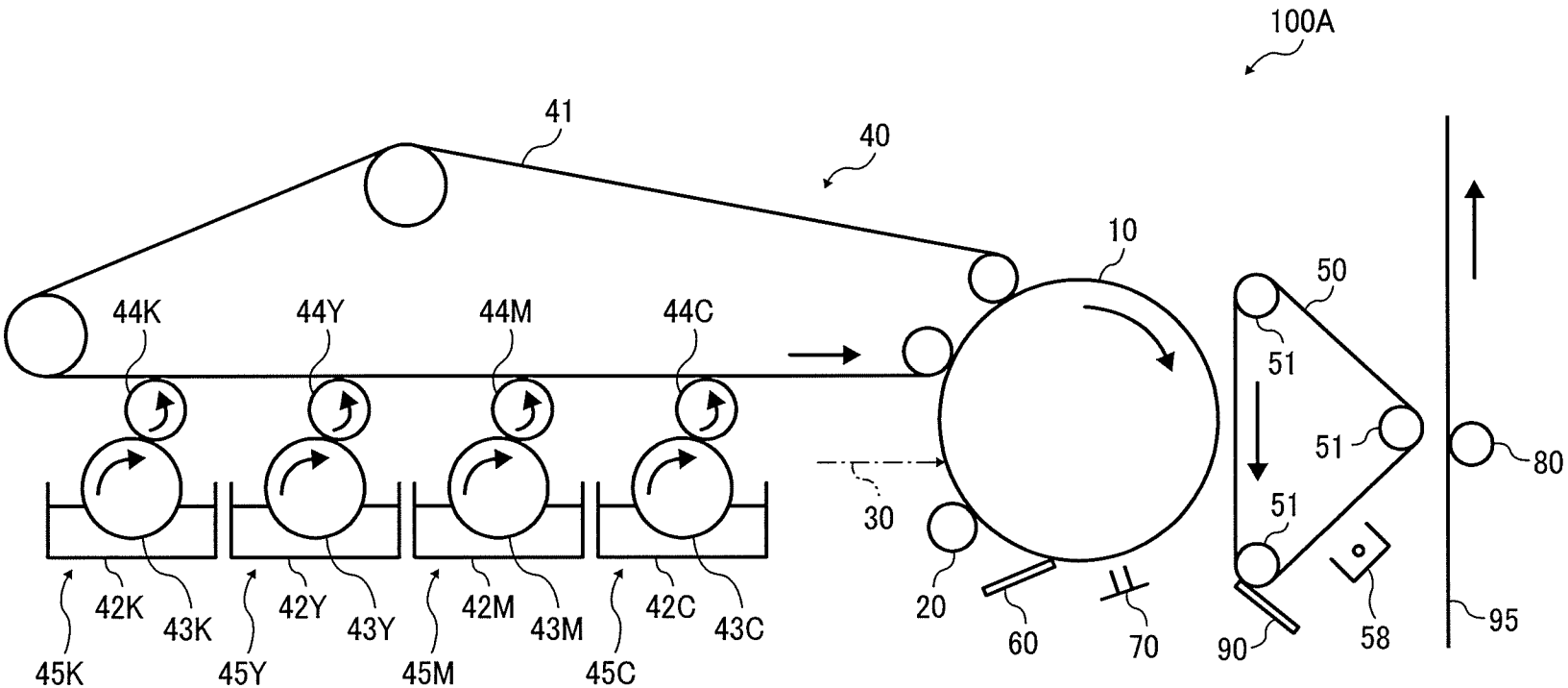
FIG. 8 is a schematic structural view of one example of an image forming apparatus of the present application.

Next, FIG. 8 illustrates one example of an image forming apparatus used in the present application. An image forming apparatus 100A includes a photoconductor drum 10, a charge roller 20, an exposure apparatus 30, a developing apparatus 40, an intermediate transfer belt 50, a cleaning apparatus 60 including a cleaning blade and a neutralizing lamp 70.

The intermediate transfer belt 50 is an endless belt stretched by three rollers 51 disposed inside thereof, and it moves in a direction of an arrow in the figure. A part of the three rollers 51 also functions as a transfer bias roller which may apply a transfer bias (primary transfer bias) on the intermediate transfer belt 50. Also, a cleaning apparatus 90 including a cleaning blade is disposed near the intermediate transfer belt 50. Further, a transfer roller 80 which can apply a transfer bias (secondary transfer bias) for transferring a toner image on transfer paper 95 is disposed facing the intermediate transfer belt 50. In addition, in a periphery of the intermediate transfer belt 50, a corona charging apparatus 58 for applying a charge to the toner image transferred on the intermediate transfer belt 50 is disposed between a contact portion of the photoconductor drum 10 with the intermediate transfer belt 50 and a contact portion of the intermediate transfer belt 50 with the transfer paper 95 with respect to a rotational direction of the intermediate transfer belt 50.

The developing apparatus 40 is configured with: a developing belt 41; and a black developing unit 45K, a yellow developing unit 45Y, a magenta developing unit 45M and a cyan developing unit 45C attached around the developing belt 41. Here, the developing unit 45 of a respective color is equipped with a developer container 42, a developer supply roller 43 and a developing roller 44. Also, the developing belt 41 is an endless belt stretched by a plurality of belt rollers and moved in a direction of an arrow in the figure. Moreover, a part of the developing belt 41 is in contact with the photoconductor drum 10.

In the color image forming apparatus 100 illustrated in FIG. 8, for example, the photoconductor drum 10 is uniformly charged by the charging roller 20. Then, the exposing device 30 imagewise exposes the photoconductor drum 10, to thereby form an electrostatic latent image. Next, the electrostatic latent image formed on the photoconductor drum 10 is developed by supplying a developer from the developing device 40, to thereby form a toner image. The toner image is transferred (primarily transferred) onto the intermediate transfer member 50, and is further transferred (secondary transferring) onto the transfer paper 95 by voltage applied from the roller 51. As a result, a transferred image is formed on the transfer paper 95. Note that, a residual toner remaining on the photoconductor 10 is removed by the cleaning device 60, and a charge on the photoconductor 10 is once eliminated by the charge-eliminating lamp 70.

Figure 9:
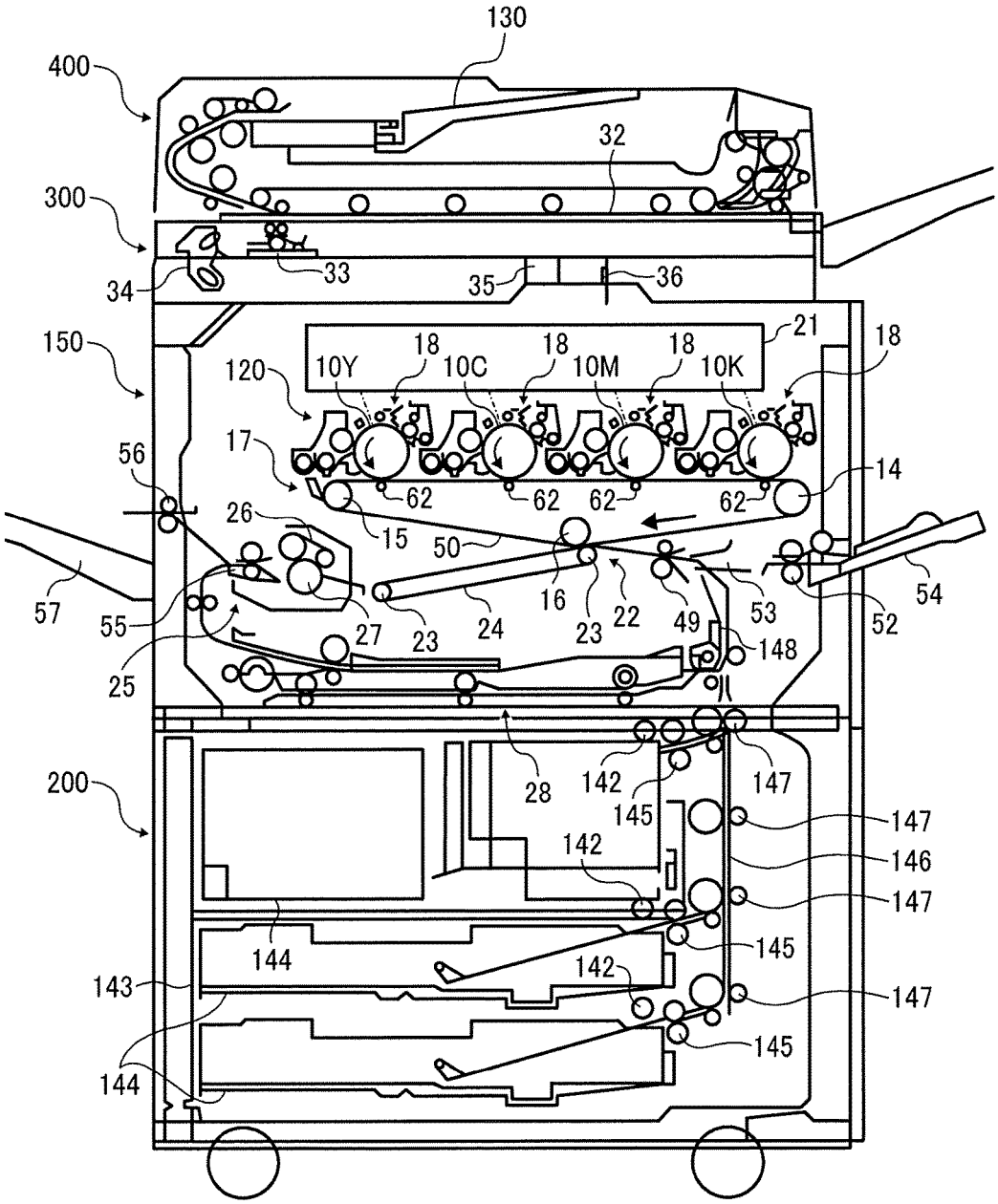
FIG. 9 is a schematic structural view of another example of an image forming apparatus of the present application.

The color image forming apparatus illustrated in FIG. 9 includes a copying device main body 150, a paper feeding table 200, a scanner 300 and an automatic document feeder (ADF) 400.

An intermediate transfer member 50, which is an endless belt type, is disposed at a central part of the copying device main body 150. The intermediate transfer member 50 is stretched around support rollers 14, 15 and 16 and can rotate in a clockwise direction in FIG. 9. Near the support roller 15, a cleaning device for the intermediate transfer member 17 is disposed to remove a residual toner remaining on the intermediate transfer member 50. On the intermediate transfer member 50 stretched around the support rollers 14 and 15, a tandem type developing device 120 is disposed in which four image forming units 18 of yellow, cyan, magenta and black are arranged in parallel so as to face to each other along a conveying direction thereof. The exposing device 21 serving as the exposing member is disposed in proximity to the tandem type developing device 120. Further, a secondary transfer device 22 is disposed on a side of the intermediate transfer member 50 opposite to the side on which the tandem type developing device 120 is disposed. In the secondary transfer device 22, the secondary transfer belt 24 which is an endless belt is stretched around a pair of rollers 23, and the transfer paper conveyed on the secondary transfer belt 24 and the intermediate transfer member 50 may contact with each other. Here, a fixing device 25 serving as the fixing unit is disposed in proximity to the secondary transfer device 22. The fixing device 25 includes a fixing belt 26 which is an endless belt and a press roller 27 which is disposed so as to be pressed against the fixing belt.

Here, in the tandem type image forming apparatus, a sheet inverting device 28 is disposed near the secondary transfer device 22 and the fixing device 25 for inverting the transfer paper in the case of forming images on both sides of the transfer paper.

Next, a method for forming a full-color image (color-copying) using the tandem type developing device 120 will be explained. First, a color document is set on a document table 130 of the automatic document feeder (ADF) 400. Alternatively, the automatic document feeder 400 is opened, the color document is set on a contact glass 32 of the scanner 300, and the automatic document feeder 400 is closed.

When a start button (not illustrated) is pressed, the scanner 300 activates after the color document is conveyed and moved to the contact glass 32 in the case the color document has been set on the automatic document feeder 400, or right away in the case the color document has been set on the contact glass 32, so that a first travelling body 33 and a second travelling body 34 travel. At this time, a light is irradiated from a light source in the first travelling body 33, the light reflected from a surface of the document is reflected by a mirror in the second travelling body 34 and then is received by a reading sensor 36 through an imaging forming lens 35. Thus, the color document (color image) is read to thereby form black, yellow, magenta and cyan image information.

The image information of black, yellow, magenta, and cyan are transmitted to the image forming units 18 (black image forming unit, yellow image forming unit, magenta image forming unit, and cyan image forming unit) in the tandem type developing device 120, and toner images of black, yellow, magenta, and cyan are formed in the image forming units. As illustrated in FIG. 3, the image forming units 18 (black image forming unit, yellow image forming unit, magenta image forming unit, and cyan image forming unit) in the tandem type developing device 120 include: electrostatic latent image bearers 10 (black electrostatic latent image bearer 10K, yellow electrostatic latent image bearer 10Y, magenta electrostatic latent image bearer 10M, and cyan electrostatic latent image bearer 10C); a charging device 160 configured to uniformly charge the electrostatic latent image bearers 10; an exposing device configured to imagewise expose to the electrostatic latent image bearers based on color image informations to form an electrostatic latent image corresponding to color images on the electrostatic latent image bearers; a developing device 61 configured to develop the electrostatic latent images with color toners (black color toner, yellow color toner, magenta color toner, and cyan color toner) to form a toner image of the color toners; a transfer charger 62 configured to transfer the toner image onto the intermediate transfer member 50; a cleaning device 63; and a charge-eliminating unit 64. Each image forming unit 18 can form monochrome images (black image, yellow image, magenta image, and cyan image) based on image formations of colors. Thus formed black image (i.e., black image formed onto the black electrostatic latent image bearer 10K), yellow image (i.e., yellow image formed onto the yellow electrostatic latent image bearer 10Y), magenta image (i.e., magenta image formed onto the magenta electrostatic latent image bearer 10M), and cyan image (i.e., cyan image formed onto the cyan electrostatic latent image bearer 10C) are sequentially transferred (primarily transferred) onto the intermediate transfer member 50 which is rotatably moved by the support rollers 14, 15 and 16. The black image, the yellow image, the magenta image, and the cyan image are superposed on the intermediate transfer member 50 to thereby form a composite color image (color transfer image).

Meanwhile, on the paper feeding table 200, one of paper feeding rollers 142 is selectively rotated to feed a sheet (recording paper) from one of the paper feeding cassettes 144 equipped in multiple stages in a paper bank 143. The sheet is separated one by one by a separation roller 145 and sent to a paper feeding path 146. The sheet (recording paper) is conveyed by a conveying roller 147 and is guided to a paper feeding path 148 in the copying device main body 150, and stops by colliding with a registration roller 49. Alternatively, a paper feeding roller 142 is rotated to feed a sheet (recording paper) on a manual feed tray 54. The sheet (recording paper) is separated one by one by a separation roller 52 and is guided to a manual paper feeding path 53, and stops by colliding with the registration roller 49. Notably, the registration roller 49 is generally used while grounded, but it may also be used in a state that a bias is being applied for removing paper dust on the sheet. Next, by rotating the registration roller 49 in accordance with the timing of the composite toner image (color transferred image) formed on the intermediate transfer member 50, the sheet (recording paper) is fed to between the intermediate transfer member 50 and the secondary transfer device 22. Thereby, the composite toner image (color transferred image) is transferred (secondarily transferred) by the secondary transfer device 22 onto the sheet (recording paper) to thereby form a color image on the sheet (recording paper). Notably, a residual toner remaining on the intermediate transfer member 50 after image transfer is removed by the cleaning device for the intermediate transfer member 17.

The sheet (recording paper) on which the color image has been transferred is conveyed by the secondary transfer device 22, and then conveyed to the fixing device 25. In the fixing device 25, the composite color image (color transferred image) is fixed on the sheet (recording paper) by the action of heat and pressure. Next, the sheet (recording paper) is switched by a switching claw 55, and discharged by a discharge roller 56 and stacked in a paper ejection tray 57. Alternatively, the sheet is switched by the switching claw 55, and is inverted by the inverting device 28 to thereby be guided to a transfer position again. After an image is formed similarly on the rear surface, the recording paper is discharged by the discharge roller 56 stacked in the paper ejection tray 57.

EXAMPLES

The present application will be further described with reference to the following Examples. However, it should be noted that the present application is not limited to these Examples. "Part(s)" mean(s) "part(s) by mass" unless otherwise specifies. "%" means "% by mass" unless otherwise specifies.

Each of the measured values in the following Examples was measured by the methods described herein. Note that, a Tg and a molecular weight of polyester resin, and crystalline polyester resin, and the like were measured by using each of the resins obtained in Production Examples.

Production Example 1

<Synthesis of Non-Crystalline Polyester Resin A>

A reaction tank with a nitrogen-introducing tube, a stirring device, and a cooling tube was charged with 229 parts by mass of bisphenol A ethylene oxide 2 mole adduct, 529 parts by mass of bisphenol A propylene oxide 3 mole adduct, 208 parts by mass of terephthalic acid, 46 parts by mass of adipic acid and 2 parts by mass of dibutyltin oxide and the resultant mixture was allowed to react under normal pressure at 230° C. for 8 hours and then to further react under a reduced pressure of 10 mmHg to 15 mmHg for 5 hours, to thereby produce intermediate polyester A'-1.

The intermediate polyester A'-1 and 44 parts by mass of trimellitic anhydride was added to the reaction tank, followed by reaction at 180° C. under normal pressure for 2 hours, to thereby obtain non-crystalline polyester resin A.

The resin was found to have a weight average molecular weight (Mw) of 6,000 and Tg of 43° C.

Production Example 2

<Synthesis of Prepolymer B-1>

A reaction tank with a nitrogen-introducing tube, a stirring device, and a cooling tube was charged with 682 parts by mass of bisphenol A ethylene oxide 2 mole adduct, 81 parts by mass of bisphenol A propylene oxide 2 mole adduct, 283 parts by mass of terephthalic acid, 22 parts by mass of trimellitic anhydride and 2 parts by mass of dibutyltin oxide. And the resultant mixture was allowed to react under normal pressure at 230° C. for 8 hours and then to further react under a reduced pressure of 10 mmHg to 15 mmHg for 5 hours, to thereby produce intermediate polyester B'-1.

The resin was found to have a weight average molecular weight (Mw) of 9,500 and Tg of 55° C.

Next, a reaction tank equipped with a cooling tube, a stirring device, and a nitrogen-introducing tube was charged with the obtained intermediate polyester and isophorone diisocyanate (IPDI) at a ratio by mole of 1.5 (as the isocyanate group of the IPDI/the hydroxyl group of the intermediate polyester). The resultant mixture was diluted with ethyl acetate so as to be a 50% ethyl acetate solution, followed by reaction at 100° C. for 5 hours, to thereby produce prepolymer B-1.

Production Example 3

<Synthesis of Prepolymer B-2>

A reaction tank equipped with a cooling tube, a stirring device, and a nitrogen-introducing tube was charged with 3-methyl-1,5-pentanediol, terephthalic acid, and adipic acid so that a ratio by mole of hydroxyl group to carboxyl group "OH/COOH" was 1.2, a diol component was composed of 1000% by mole of 3-methyl-1,5-pentanediol, a dicarboxylic acid component was composed of 50% by mole of terephthalic acid and 50% by mole of adipic acid. Moreover, titanium tetraisopropoxide (1,000 ppm relative to the resin component) was added thereto.

The resultant mixture was heated to 200° C. for about 4 hours and then heated to 230° C. for 2 hours, and was allowed to react until no flowing water was formed.

Thereafter, the reaction mixture was allowed to further react for 5 hours under a reduced pressure of 10 mmHg to 15 mmHg, to thereby produce intermediate polyester B'-2.

Next, a reaction tank equipped with a cooling tube, a stirring device, and a nitrogen-introducing tube was charged with the intermediate polyester B'-2 and isophorone diisocyanate (IPDI) at a ratio by mole of 1.5 (as the isocyanate group of the IPDI/the hydroxyl group of the intermediate polyester). The resultant mixture was diluted with ethyl acetate so as to be a 50% ethyl acetate solution, followed by reaction at 100° C. for 5 hours, to thereby produce prepolymer B-2.

Production Example 4

<Synthesis of Crystalline Polyester Resin C>

A four-necked flask of 5 L equipped with a nitrogen-introducing tube, a dehydration tube, a stirring device, and a thermocouple was charged with dodecanedioic acid and 1,6-hexanediol so that a ratio by mole of hydroxyl group to carboxyl group "OH/COON" was 0.9. Moreover, titanium tetraisopropoxide (500 ppm relative to the resin component) was added thereto, and the resultant mixture was allowed to react under normal pressure at 180° C. for 10 hours, heated to 200° C., allowed to react 3 hours, and then to react under a pressure of 8.3 kPa for 2 hours to thereby obtain a crystalline polyester resin C.

The resin was found to have a weight average molecular weight (Mw) of 15,000 and melting point of 70° C.

Production Example 5

<Production of Masterbatch>

HENSCHEL MIXER (manufactured by NIPPON COKE & ENGINEERING COMPANY, LIMITED) was charged with 1,200 parts of water, 540 parts of carbon black (PRINTEX35, manufactured by Evonik Industries AG) [DBP oil absorption=42 mL/100 mg, pH=9.5], and 1,200 parts of non-modified polyester, followed by mixing together to thereby obtain a mixture. The mixture was kneaded at 150° C. for 30 min using a two-roll mill, followed by being roll-cooled and pulverized with a pulverizer (manufactured by HOSOKAWA Micron Corporation) to thereby obtain [Masterbatch].

Production Example 6

<Production of Wax Dispersion Liquid>

In a reaction tank that was equipped with a thermometer and a stirrer, the following were put: 378 parts of non-modified polyester, 110 parts of carnauba wax, 22 parts of metal complex of salicylic acid (E-84 manufactured by ORIENT CHEMICAL INDUSTRIES CO, LTD.) and 947 parts of ethyl acetate. The above substances were sufficiently stirred as the substances were heated to 80° C. Then after the substances were kept at 80° C. for 5 hours, the substances were cooled down over one hour to 30° C. Next, in the reaction tank the following were put: 500 parts of masterbatch and 500 parts of ethyl acetate, and the substances were mixed for one hour to obtain a solution of materials.

1324 parts of the solution of materials were put in the reaction tank and then bead-milled by Ultra Visco Mill (manufactured by AIMEX) under the following conditions: Liquid feeding speed: 1.0 kg/hr, Disk peripheral speed: 6 m/sec, Filling volume of 0.5 mm-diameter zirconia beads: 80% by volume, Number of paths: 3. As a result, the following dispersing C.I. pigment and carnauba wax was obtained: [Wax dispersion liquid].

Production Example 7

<Production of Inorganic Laminar Compound A>

100 parts of a montmorillonite compound that was modified with quaternary ammonium salts at least partially having benzyl groups (Organically-modified laminar inorganic mineral, CLAYTONE APA, manufactured by Southern Clay Products) were put in 1,200 parts of water and the mixture was stirred for 15 min by T.K.HOMO DISPER (manufactured by PRIMIX CORPORATION) to obtain a slurried inorganic laminar compound. And then 50 parts of silane coupling agent "(Trifluoropropyl)trimethoxysilane" was added and was stirred for more 10 min. After the obtained slurry was filtered and dried at 150° C. for 90 min, the obtained slurry was pulverized by ball-mill to obtain [Inorganic Laminar Compound A].

Production Example 8

<Production of Inorganic Laminar Compound B>

100 parts of a montmorillonite compound that was modified with quaternary ammonium salts at least partially having benzyl groups (Organically-modified laminar inorganic mineral, CLAYTONE APA, manufactured by Southern Clay Products) were put in 1,200 parts of water and the mixture was stirred for 15 min by T.K.HOMO DISPER (manufactured by PRIMIX CORPORATION) to obtain a slurried inorganic laminar compound. And then 10 parts of silane coupling agent "(Trifluoropropyl)trimethoxysilane" was added and was stirred for more 10 min. After the obtained slurry was filtered and dried at 150° C. for 90 min, the obtained slurry was pulverized by ball-mill to obtain [Inorganic Laminar Compound B].

Production Example 9

<Production of Inorganic Laminar Compound C>

100 parts of a montmorillonite compound that was modified with quaternary ammonium salts at least partially having benzyl groups (Organically-modified laminar inorganic mineral, CLAYTONE APA, manufactured by Southern Clay Products) were put in 1,200 parts of water and the mixture was stirred for 15 min by T.K.HOMO DISPER (manufactured by PRIMIX CORPORATION) to obtain a slurried inorganic laminar compound. And then 1 parts of silane coupling agent "(Trifluoropropyl)trimethoxysilane" was added and was stirred for more 10 min. After the obtained slurry was filtered and dried at 150° C. for 90 min, the obtained slurry was pulverized by ball-mill to obtain [Inorganic Laminar Compound C].

Production Example 10

<Production of Inorganic Laminar Compound D>

100 parts of a non-modified montmorillonite compound ("KUNIPIA" manufactured by KUNIMINE INDUSTRIES CO., LTD.) were put in 1,200 parts of water and the mixture was stirred for 15 min by T.K.HOMO DISPER (manufactured by PRIMIX CORPORATION) to obtain a slurried inorganic laminar compound. And then 10 parts of silane coupling agent "(Trifluoropropyl)trimethoxysilane" was added and was stirred for more 10 min. After the obtained slurry was filtered and dried at 150° C. for 90 min, the obtained slurry was pulverized by ball-mill to obtain [Inorganic Laminar Compound D].

Production Example 11

<Production of Inorganic Laminar Compound E>

100 parts of a montmorillonite compound that was modified with ammonium salts at least partially having polyoxyethylene groups (Organically-modified laminar inorganic mineral, CLAYTONE HY, manufactured by Southern Clay Products) were put in 1,200 parts of water and the mixture was stirred for 15 min by T.K.HOMO DISPER (manufactured by PRIMIX CORPORATION) to obtain a slurried inorganic laminar compound. And then 10 parts of silane coupling agent "(Trifluoropropyl)trimethoxysilane" was added and was stirred for more 10 min. After the obtained slurry was filtered and dried at 150° C. for 90 min, the obtained slurry was pulverized by ball-mill to obtain [Inorganic Laminar Compound E]

Production Example 12

<Synthesis of Ketimine>

A reaction container equipped with a stirring rod and a thermometer was charged with isophorone diamine (170 parts) and methyl ethyl ketone (75 parts), followed by reaction at 50.degree. C. for 5 hours, to thereby obtain [ketimine compound]. The amine value of the obtained [ketimine compound] was found to be 418.

Example 1

<Production of Toner Component Dispersion Liquid>

1,324 parts of ethyl acetate solution of 65% by mass non-crystalline polyester resin A were charged in wax dispersion liquid. 1 parts of [Inorganic Laminar Compound B] was added in 200 parts of the above dispersion liquid obtained by Ultra Visco Mill under the following conditions: Liquid feeding speed: 1.0 kg/hr, Disk peripheral speed: 6 m/sec, Filling volume of 0.5 mm-diameter zirconia beads: 80% by volume, Number of paths: 1. And then the substance was stirred for 30 min by T.K.HOMO DISPER (manufactured by PRIMIX CORPORATION) to obtain [Toner Component Dispersion Liquid].

<Preparation of Oil Phase>

Into a vessel, 749 parts of [Toner Component Dispersion Liquid], 115 parts of prepolymer B-1 and 2.9 parts of [ketimine compound] were charged, followed by mixing by a TK Homomixer (product of PRIMIX Corporation) at 5,000 rpm for 1 min, to thereby obtain [oil phase].

<Synthesis of Particle Dispersion Liquid>

A reaction vessel equipped with a stirring bar and a thermometer was charged with 683 parts of water, 11 parts of a sodium salt of sulfuric acid ester of methacrylic acid-ethylene oxide adduct (ELEMINOL RS-30, product of Sanyo Chemical Industries, Ltd.), 83 parts of styrene, 83 parts of methacrylic acid, 110 parts of butyl acrylate and 1 part of ammonium persulfate, and the resulting mixture was stirred for 15 minutes at 400 rpm, to thereby obtain a white emulsion. The obtained emulsion was heated to have the system temperature of 75° C., and was then allowed to react for 5 hours. To the resultant, 30 parts of a 1% ammonium persulfate aqueous solution was added, followed by aging for 5 hours at 75° C., to thereby obtain [Particle Dispersion Liquid].

<Preparation of Aqueous Phase>

Water (990 parts), 83 parts of the [particle dispersion liquid 1], 37 parts of a 48.5% aqueous solution of sodium dodecyldiphenyl ether disulfonate (ELEMINOL MON-7, product of Sanyo Chemical Industries Ltd.), 135 parts of aqueous solution of 1% sodium carboxymethylcellulose (SEROGEN BS-H-3 manufactured by DKS CO,. LTD.) and 90 parts of ethyl acetate were mixed and stirred, to thereby obtain an opaque white liquid. The obtained liquid was used as [aqueous phase].

<Production of Toner>

To a container charged with 867 parts of the [oil phase], 1,200 parts of the [aqueous phase] was added, and the resulting mixture was mixed by a TK Homomixer at 13,000 rpm for 20 minutes, to thereby obtain [emulsified slurry].

A container equipped with a stirrer and a thermometer was charged with the [emulsified slurry], followed by removing the solvent therein at 30° C. for 8 hours. Thereafter, the resultant was matured at 45° C. for 4 hours, to thereby obtain [dispersion slurry].

After subjecting 100 parts of the [dispersion slurry] to filtration under the reduced pressure, the obtained cake was added ion-exchanged water (100 parts), followed by mixing with TK Homomixer (at 12,000 rpm for 10 minutes) and then filtration.

10% sodium hydroxide aqueous solution was added to the filtration cake obtained to be pH 2.8, followed by mixing with TK Homomixer (at 12,000 rpm for 10 minutes) and then filtration.

And then the obtained cake was added ion-exchanged water (300 parts), followed by mixing with TK Homomixer (at 12,000 rpm for 10 minutes) and then twice filtration.

Next, the obtained cake was dried with an air-circulating drier at 45° C. for 48 hours, and then was caused to pass through a sieve with a mesh size of 75 μm to thereby obtain [toner base particles].

The [toner base particles] (100 parts by mass), 1.0 parts by mass of hydrophobic silica and 0.5 parts by mass of titanium oxide were mixed together in a Henschel mixer (manufactured by NIPPON COKE & ENGINEERING CO., LTD) to thereby obtain [Toner 1].

<Production of Developer>

Each of the obtained toner (5 parts) and each of the carrier (95 parts) which was used in "imageo MP C 4300" (manufactured by RICOH CO,. LTD.) were mixed to thereby prepare a developer.

The obtained toners in Examples described above was used to prepare the developer, and each of the properties thereof was evaluated. Results are shown in Table 1-1.

<Low Temperature Fixing Ability and Hot Offset Resistance>

After the developer was set in "imageo MP C 4300", using the developer, a rectangular solid image of 2 cm×15 cm was formed on paper having a size of A4 (T6000 70 W long grain, product of Ricoh Company, Ltd.) so that the toner was deposited in an amount of 0.40 mg/cm2. At this time, the surface temperature of the fixing roller was changed and the solid image were observed if an image remaining after development of the solid image was fixed in other places than the intended places. In this manner low temperature fixing ability and hot offset resistance were evaluated.

—Evaluation Criteria of Low Temperature Fixing Ability—

A: Less than 110° C.

B: More than 110° C. but less than 120° C.

C: More than 120° C. but less than 130° C.

D: More than 130° C.

—Evaluation Criteria of Hot Offset Resistance—

A: More than 170° C.

B: More than 160° C. but less than 170° C.

C: More than 150° C. but less than 160° C.

D: Less than 150° C.

—Scumming—

After printing 30,000 sheets of the image having image part ratio 50% by monochromatic mode of "imageo MP C 4300" (manufactured by RICOH CO,. LTD.), when a white image was printed, printing was stopped. Developer on the image bearer were tape-transferred, difference between image density of transferred tape and non-transferred tape were measured by 938SpectroDensitometer (manufactured by X-Rite).

The less difference the better for scumming, the results were evaluated in better order; A, B, C, D.

—Scatter of Toner—

After printing straight 50,000 sheets by imagio Color2800 (manufactured by RICOH CO,. LTD.), level of toner taint in the machine was confirmed.

A: No Problem

B: A little scatter but no problem to use

C: Significant scatter

—Cleaning Ability—

After cleaning step, transfer residual toner on the image bearer were moved to a white paper by "Scotch Tape" (manufactured by 3M Japan Limited) and measured by Macbeth Transmission Reflection Densitometer RD514. The results were evaluated.

A(GOOD): Difference between the result ant blank is less than 0.01

B(BAD): Difference between the result ant blank is beyond 0.01

—Evaluation Criteria of Charging Ability—

1. Charge Quantity for 1 Min 10 g of the toner and 100 g of ferrite carrier were charged until 30% volume of stainless steel pot until at 28° C. and 80% humidity and stirred at 100 rpm for 1 min. Charge Quantity (μC/g) of the developer were measured by "TB-200" (manufactured by TOSHIBA CHEMICAL). The toners were measured by blowoff method.

2. Charge Quantity for 10 Min

The toners were measured for 10 min as it for above 1.

—Charging Stability—

1) Charging Stability at High-Temperature and High-Humidity Conditions

While printing 100,000 sheets of the image having image part ratio 7% by monochromatic mode of "imageo MP C 4300" (manufactured by RICOH CO,. LTD.) at 40° C. and 90% humidity, parts of the developer were sampled every 1,000 sheets printing and measured charge quantity by blowoff method.

In the case change of charge quantity was less than 5 μC/g, it was evaluated A. In the case change of charge quantity was less than 10 μC/g, it was evaluated B. In the case change of charge quantity was beyond 10 μC/g, it was evaluated C.

2) Charging Stability at Low-Temperature and Low-Humidity Conditions

While printing 100,000 sheets of the image having image part ratio 7% by monochromatic mode of "imageo MP C 4300" (manufactured by RICOH CO,. LTD.) at 10° C. and 15% humidity, parts of the developer were sampled every 1,000 sheets printing and measured charge quantity by blowoff method.

In the case change of charge quantity was less than 5 μC/g, it was evaluated A. In the case change of charge quantity was less than 10 μC/g, it was evaluated B. In the case change of charge quantity was beyond 10 μC/g, it was evaluated C.

Blowoff method of above 1) and 2) were under follow method. 10 g of the toner and 100 g of ferrite carrier were charged until 30% volume of stainless steel pot until at 20° C. and 50% humidity and stirred at 100 rpm for 10 min. Charge Quantity (μC/g) of the developer were measured by "TB-200" (manufactured by TOSHIBA CHEMICAL).

Example 2

Toner of Example 2 (Toner 2) were obtained in the same manner as in Example 1 except that [Inorganic Laminar Compound B] of Example 1 was changed to [Inorganic Laminar Compound A]. Properties of the toners of Example 2 were evaluated in the same manner as in Example 1. Results are shown in Table 1-1.

Example 3

Toner of Example 3 (Toner 3) were obtained in the same manner as in Example 1 except that [Inorganic Laminar Compound B] of Example 1 was changed to [Inorganic Laminar Compound C]. Properties of the toners of Example 3 were evaluated in the same manner as in Example 1. Results are shown in Table 1-1.

Example 4

Toner of Example 4 (Toner 4) were obtained in the same manner as in Example 1 except that 1 parts of [Inorganic Laminar Compound B] of Example 1 was changed to 0.1 parts [Inorganic Laminar Compound B]. Properties of the toners of Example 4 were evaluated in the same manner as in Example 1. Results are shown in Table 1-1.

Example 5

Toner of Example 5 (Toner 5) were obtained in the same manner as in Example 1 except that 1 parts of [Inorganic Laminar Compound B] of Example 1 was changed to 3 parts [Inorganic Laminar Compound B]. Properties of the toners of Example 5 were evaluated in the same manner as in Example 1. Results are shown in Table 1-1.

Example 6

Toner of Example 6 (Toner 6) were obtained in the same manner as in Example 1 except that [Inorganic Laminar Compound B] of Example 1 was changed to [Inorganic Laminar Compound D]. Properties of the toilers of Example 6 were evaluated in the same manner as in Example 1. Results are shown in Table 1-1.

Example 7

Toner of Example 7 (Toner 7) were obtained in the same manner as in Example 1 except that [Inorganic Laminar Compound B] of Example 1 was changed to [Inorganic Laminar Compound E]. Properties of the toners of Example 7 were evaluated in the same manner as in Example 1. Results are shown in Table 1-1.

Example 8

<Production of Toner Component Dispersion Liquid>

1,123 parts of ethyl acetate solution of 65% by mass non-crystalline polyester resin A and 650 parts of ethyl acetate solution of 20% by mass crystalline polyester C were charged in wax dispersion liquid.

1 parts of [Inorganic Laminar Compound B] was added in 472 parts of the above dispersion liquid obtained by Ultra Visco Mill under the following conditions: Liquid feeding speed: 1.0 kg/hr, Disk peripheral speed: 6 m/sec, Filling volume of 0.5 mm-diameter zirconia beads: 80% by volume, Number of paths: 1.

And then the substance was stirred for 30 min by T.K.HOMO DISPER (manufactured by PRIMIX CORPORATION) to obtain [Toner Component Dispersion Liquid].

<Preparation of Oil Phase>

Into a vessel, 749 parts of [Toner Component Dispersion Liquid], 115 parts of prepolymer B-2 and 2.9 parts of [ketimine compound] were charged, followed by mixing by a TK Homomixer (product of PRIMIX Corporation) at 5,000 rpm for 1 min, to thereby obtain [oil phase].

<Synthesis of Particle Dispersion Liquid>

A reaction vessel equipped with a stirring bar and a thermometer was charged with 683 parts of water, 11 parts of a sodium salt of sulfuric acid ester of methacrylic acid-ethylene oxide adduct (ELEMINOL RS-30, product of Sanyo Chemical Industries, Ltd.), 83 parts of styrene, 83 parts of methacrylic acid, 110 parts of butyl acrylate and 1 part of ammonium persulfate, and the resulting mixture was stirred for 15 minutes at 400 rpm, to thereby obtain a white emulsion.

The obtained emulsion was heated to have the system temperature of 75° C., and was then allowed to react for 5 hours. To the resultant, 30 parts of a 1% ammonium persulfate aqueous solution was added, followed by aging for 5 hours at 75° C., to thereby obtain [Particle Dispersion Liquid].

<Preparation of Aqueous Phase>

Water (990 parts), 83 parts of the [particle dispersion liquid], 37 parts of a 48.5% aqueous solution of sodium dodecyldiphenyl ether disulfonate (ELEMINOL MON-7, product of Sanyo Chemical Industries Ltd.), 135 parts of aqueous solution of 1% sodium carboxymethylcellulose (SEROGEN BS-H-3 manufactured by DKS CO,. LTD.) and 90 parts of ethyl acetate were mixed and stirred, to thereby obtain an opaque white liquid. The obtained liquid was used as [aqueous phase].

<Production of Toner>

To a container charged with 867 parts of the [oil phase], 1,200 parts of the [aqueous phase] was added, and the resulting mixture was mixed by a TK Homomixer at 13,000 rpm for 20 minutes, to thereby obtain [emulsified slurry].

A container equipped with a stirrer and a thermometer was charged with the [emulsified slurry], followed by removing the solvent therein at 30° C. for 8 hours. Thereafter, the resultant was matured at 45° C. for 4 hours, to thereby obtain [dispersion slurry].

After subjecting 100 parts of the [dispersion slurry] to filtration under the reduced pressure, the obtained cake was added ion-exchanged water (100 parts), followed by mixing with TK Homomixer (at 12,000 rpm for 10 minutes) and then filtration.

10% sodium hydroxide aqueous solution was added to the filtration cake obtained to be pH 2.8, followed by mixing with TK Homomixer (at 12,000 rpm for 10 minutes) and then filtration.

And then the obtained cake was added ion-exchanged water (300 parts), followed by mixing with TK Homomixer (at 12,000 rpm for 10 minutes) and then twice filtration.

Next, the obtained cake was dried with an air-circulating drier at 45° C. for 48 hours, and then was caused to pass through a sieve with a mesh size of 75 μm to thereby obtain [toner base particles].

The [toner base particles] (100 parts by mass), 1.0 parts by mass of hydrophobic silica and 0.5 parts by mass of titanium oxide were mixed together in a Henschel mixer (manufactured by NIPPON COKE & ENGINEERING CO., LTD) to thereby obtain [Toner 8]. Properties of the toners of Example 8 (Toner 8) were evaluated in the same manner as in Example 1. Results are shown in Table 1-1.

Comparative Example 1

Toner of Comparative Example 1 (Toner 9) were obtained in the same manner as in Example 1 except that [Inorganic Laminar Compound B] of Example 1 was changed to Organically-modified laminar inorganic mineral, "CLAYTONE APA". Properties of the toners of Comparative Example 1 were evaluated in the same manner as in Example 1. Results are shown in Table 1-2.

Comparative Example 2

Toner of Comparative Example 2 (Toner 10) were obtained in the same manner as in Example 1 except that [Inorganic Laminar Compound B] of Example 1 was changed to a non-modified montmorillonite compound ("KUNIPIA" manufactured by KUNIMINE INDUSTRIES CO., LTD.). Properties of the toners of Comparative Example 2 were evaluated in the same manner as in Example 1. Results are shown in Table 1-2.

Comparative Example 3

To obtain toner of Comparative Example 3, toner base particles of Comparative Example 1 were charged in water solvent dispersing 1% by mass the follow fluorine compound (X) to be 0.09 parts of the fluorine compound against the toner. After the fluorine compound was adhered to the toner, the toner was dried with an air-circulating drier at 45° C. for 48 hours. Toner of Comparative Example 3 (Toner 11) were obtained in the same manner as in Comparative Example 1 except adding step of passing through a sieve with a mesh size of 75 μm.

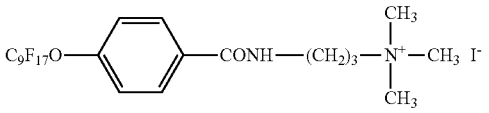

Properties of the toners of Comparative Example 3 were evaluated in the same manner as in Example 1. Results are shown in Table 1-2.

Comparative Example 4

To obtain toner of Comparative Example 4, toner base particles of Comparative Example 1 were charged in water solvent dispersing 10% by mass the follow fluorine compound (X) to be 0.28 parts of the fluorine compound against the toner. After the fluorine compound was adhered to the toner, the toner was dried with an air-circulating drier at 45° C. for 48 hours. Toner of Comparative Example 4 (Toner 12) were obtained in the same manner as in Comparative Example 1 except adding step of passing through a sieve with a mesh size of 75 μm.

Properties of the toners of Comparative Example 4 were evaluated in the same manner as in Example 1. Results are shown in Table 1-2.

Comparative Example 5

Toner of Comparative Example 5 (Toner 13) were obtained in the same manner as in Example 1 except that inorganic laminar compound was not added. Properties of the toners of Comparative Example 5 were evaluated in the same manner as in Example 1. Results are shown in Table 1-2.

Comparative Example 6

To obtain toner of Comparative Example 6, toner base particles of Example 1 were charged in water solvent dispersing 1% by mass the follow fluorine compound (X) to be 0.09 parts of the fluorine compound against the toner. After the fluorine compound was adhered to the toner, the toner was dried with an air-circulating drier at 45° C. for 48 hours. Toner of Comparative Example 6 (Toner 14) were obtained in the same manner as in Example 1 except adding step of passing through a sieve with a mesh size of 75 μm.

Comparative Example 7

To obtain toner of Comparative Example 7, toner base particles of Example 1 were charged in water solvent dispersing 10% by mass the follow fluorine compound (X) to be 0.28 parts of the fluorine compound against the toner. After the fluorine compound was adhered to the toner, the toner was dried with an air-circulating drier at 45° C. for 48 hours. Toner of Comparative Example 7 (Toner 15) were obtained in the same manner as in Example 1 except adding step of passing through a sieve with a mesh size of 75 μm.

TABLE 1

| | | Toner1 EX1 | Toner2 EX2 | Toner EX3 | Toner4 EX4 | Toner5 EX5 | Toner6 EX6 | Toner7 EX7 | Toner8 EX8 |
|---|---|---|---|---|---|---|---|---|---|
| AB/B | | 0.6 | 0.66 | 0.51 | 0.57 | 0.61 | 0.6 | 0.62 | 0.6 |
| (A − AB)/A | | 0.17 | 0.1 | 0.21 | 0.18 | 0.17 | 0.2 | 0.19 | 0.21 |
| Tg(° C.) | | 48 | 48 | 48 | 47 | 48 | 48 | 48 | 42 |
| Dv(μm) | | 5.5 | 5.4 | 5.2 | 5.8 | 5.3 | 5.8 | 5.8 | 5.6 |
| Dn(μm) | | 4.8 | 4.5 | 4.5 | 4.9 | 4.7 | 4.7 | 4.8 | 4.7 |
| Dv/Dn | | 1.15 | 1.20 | 1.16 | 1.18 | 1.13 | 1.23 | 1.21 | 1.19 |
| Average Circulity | | 0.964 | 0.966 | 0.961 | 0.967 | 0.960 | 0.969 | 0.965 | 0.966 |
| Charge | 1 min | −44 | −44 | −42 | −40 | −45 | −42 | −41 | −43 |
| Quantity (μc/g) | 10 min | −46 | −45 | −45 | −40 | −46 | −43 | −44 | −45 |
| Charging | HH | A | A | A | A | A | A | A | A |
| Stability | LL | A | A | A | A | A | A | A | A |
| Scumming | | A | A | A | A | B | A | A | A |
| Scatter | | A | A | A | A | A | A | A | A |
| Cleaning | | A | A | A | A | A | A | A | A |
| Low Temperature Fixing | | B | B | B | A | C | B | B | A |
| Hot Offset Resistance | | A | A | A | A | A | A | A | A |

TABLE 2

| | | Toner9 Com1 | Toner10 Com2 | Toner11 Com3 | Toner12 Com4 | Toner13 Com5 | Toner14 Com6 | Toner15 Com7 |
|---|---|---|---|---|---|---|---|---|
| AB/B | | 0 | 0 | 0.42 | 0.52 | 0 | 0.72 | 0.74 |
| (A − AB)/A | | 0 | 0 | 0.36 | 0.24 | 0 | 0.38 | 0.56 |
| Tg(° C.) | | 48 | 48 | 48 | 49 | 46 | 48 | 49 |
| Dv(μm) | | 5.2 | 6 | 5.2 | 5.3 | 5.7 | 5.6 | 5.5 |
| Dn(μm) | | 4.8 | 4.9 | 4.8 | 4.8 | 4.6 | 4.8 | 4.6 |
| Dv/Dn | | 1.08 | 1.22 | 1.08 | 1.08 | 1.24 | 1.17 | 1.20 |
| Average Circulity | | 0.962 | 0.968 | 0.962 | 0.962 | 0.975 | 0.963 | 0.964 |
| Charge | 1 min | −32 | −29 | −35 | −37 | −25 | −35 | −38 |
| Quantity (μc/g) | 10 min | −33 | −30 | −31 | −30 | −26 | −30 | −30 |
| Charging | HH | B | C | B | B | C | A | A |
| Stability | LL | B | C | B | B | C | A | A |
| Scumming | | C | C | C | C | D | C | C |
| Scatter | | C | C | C | C | C | C | C |
| Cleaning | | A | A | A | A | B | A | A |
| Low Temperature Fixing | | A | A | C | C | A | B | C |
| Hot Offset Resistance | | A | A | A | A | B | A | A |

Preferred embodiments of the application, described herein such that one of skill in this art can make and use them, include:

<1> A toner comprising:

a polyester resin, fluorine and aluminum, wherein the toner satisfies formulae (1) and (2), $$1.00 \geq AB/B \geq 0.50 \quad (1)$$

$$0 \leq (A-AB)/A \leq 0.25 \quad (2)$$

where A represents an area which the fluorine exists measured by Energy Dispersive X-ray Spectroscopy (EDS), B represents an area which the aluminum exists measured by Energy Dispersive X-ray Spectroscopy (EDS) and AB represents an overlapping area between A and B.

<2> The toner of embodiment <1>, wherein the toner includes an inorganic laminar compound having the fluorine on a surface thereof.

<3> The toner of embodiment <2>, wherein the inorganic laminar compound is one in which organic ions are at least partially substituted for ions present between layers of the inorganic laminar compound.

<4> A toner stored unit which stores the toner of embodiment <1>.

<5> An image forming apparatus, comprising:

an image bearer;

an electrostatic latent image former to form an electrostatic latent image on the image bearer;

a developing unit containing a toner and configured to develop the electrostatic latent image formed on the electrostatic latent image bearer to form a visible image;

a transfer unit to transfer the visible image onto a recording medium; and a fix unit to fix the visible image onto the recording medium wherein the image forming apparatus includes the toner of embodiment <1>.

<6> An image forming method, comprising:

forming an electrostatic latent image on an image bearer;

developing the electrostatic latent image formed on the electrostatic latent image bearer to form a visible image;

transfering the visible image onto a recording medium; and fixing the visible image onto the recording medium wherein the image forming method includes the toner of embodiment 1.

As used herein the terms composed of, contains, containing, and terms similar thereto, when referring to the ingredients, parts, reactants, etc., of a composition, component, etc., to method steps, etc., mean, in their broadest sense, "includes at least" (i.e., comprises) but also include within their definition all those gradually restricted meanings until and including the point where only the enumerated materials or steps are included (e.g., consisting essentially of and consisting of). As used herein the words "a" and "an" and the like carry the meaning of "one or more."

The above written description provides a manner and process of making and using the embodiments described such that any person skilled in this art is enabled to make and use the same, this enablement being provided in particular for the subject matter of the appended claims, which make up a part of the original description. All references, patents, applications, tests, standards, documents, publications, brochures, texts, articles, etc. mentioned herein are incorporated herein by reference. Where a numerical limit or range is stated, the endpoints are included. Also, all values and subranges within a numerical limit or range are specifically included as if explicitly written out. The above description is provided in the context of a particular application and its requirements. Various modifications to the described embodiments will be readily apparent to those skilled in the art, and the generic principles defined herein may be applied to other embodiments and applications without departing from the spirit and scope of the applicaation. Thus, this application is not intended to be limited to the embodiments shown, but is to be accorded the widest scope consistent with the principles and features disclosed herein. In this regard, certain embodiments within the application may not show every benefit described, considered broadly.

What is claimed is:

1. A toner comprising:

a polyester resin, fluorine and aluminum, wherein the toner satisfies formulae (1) and (2), $$1.00 \geq AB/B \geq 0.50 \quad (1)$$

$$0 \leq (A-AB)/A \leq 0.25 \quad (2)$$

where A represents an area in which the fluorine exists as measured by Energy Dispersive X-ray Spectroscopy (EDS), B represents an area in which the aluminum exists as measured by Energy Dispersive X-ray Spectroscopy (EDS), and AB represents an overlapping area between A and B.

2. The toner of claim 1, wherein the toner further comprises an inorganic laminar compound having the fluorine on a surface thereof.

3. The toner comprising of claim 2, wherein the inorganic laminar compound is one in which organic ions are at least partially substituted for ions present between layers.

4. A toner stored unit which stores the toner of claim 1.

5. An image forming apparatus, comprising:

an image bearer;

an electrostatic latent image former to form an electrostatic latent image on the image bearer;

a developing unit containing a toner and configured to develop the electrostatic latent image formed on the electrostatic latent image bearer to form a visible image;

a transfer unit to transfer the visible image onto a recording medium; and a fixing unit to fix the visible image onto the recording medium wherein the toner is the toner of claim 1.

6. An image forming method, comprising:

forming an electrostatic latent image on an image bearer;

developing the electrostatic latent image formed on the electrostatic latent image bearer with toner to form a visible image;

transferring the visible image onto a recording medium; and fixing the visible image onto the recording medium wherein the toner is the toner of claim 1.

* * * * *